US008317556B2

(12) United States Patent
Suzuki et al.

(10) Patent No.: US 8,317,556 B2
(45) **Date of Patent: *Nov. 27, 2012**

(54) BOAT PROPULSION SYSTEM, AND CONTROL DEVICE AND CONTROL METHOD THEREFOR

(75) Inventors: Takayoshi Suzuki, Shizuoka (JP); Hideaki Matsushita, Shizuoka (JP); Daisuke Nakamura, Shizuoka (JP); Tsugunori Konakawa, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 518 days.

This patent is subject to a terminal disclaimer.

(21) Appl. No.: 12/389,550

(22) Filed: Feb. 20, 2009

(65) Prior Publication Data

US 2009/0215337 A1 Aug. 27, 2009

(30) Foreign Application Priority Data

Feb. 22, 2008 (JP) ..... 2008-041200

(51) Int. Cl.
*B63H 21/21* (2006.01)

(52) U.S. Cl. ..... 440/86; 440/75

(58) Field of Classification Search ..... 440/75, 440/84, 86; 701/21, 64; 477/79, 80
See application file for complete search history.

(56) References Cited

U.S. PATENT DOCUMENTS

| | | | | |
|---|---|---|---|---|
| 6,582,259 | B1 * | 6/2003 | Mansson et al. | 440/75 |
| 7,942,712 | B2 * | 5/2011 | Suzuki et al. | 440/75 |
| 2006/0213301 | A1 | 9/2006 | Mizuguchi et al. | |

FOREIGN PATENT DOCUMENTS

| | | | |
|---|---|---|---|
| JP | 06-094118 | A | 4/1994 |
| JP | 2001-018892 | A | 1/2001 |
| JP | 2001-039393 | A | 2/2001 |
| JP | 2006-264361 | A | 10/2006 |

* cited by examiner

*Primary Examiner* — Edwin Swinehart
(74) *Attorney, Agent, or Firm* — Keating & Bennett, LLP

(57) ABSTRACT

A boat propulsion system includes a power source, a propulsion section, a shift position switching mechanism arranged to switch among a first shift position, a second shift position, and a neutral position, a gear ratio switching mechanism, an actuator, and a control section. When switching is to be performed from the neutral position to the first shift position and the high-speed gear ratio, the control section is arranged to cause the actuator to, maintain the low-speed gear ratio, switch to the first shift position, and then establish the high-speed gear ratio when the current gear ratio of the gear ratio switching mechanism is the low-speed gear ratio, and cause the actuator to establish the low-speed gear ratio before switching to the first shift position, switch to the first shift position, and then establish the high-speed gear ratio when the current gear ratio of the gear ratio switching mechanism is the high-speed gear ratio. This arrangement improves the durability of a power source and a power transmission mechanism in a boat propulsion system including an electronically controlled shift mechanism.

7 Claims, 21 Drawing Sheets

| Part name (reference numeral) | ○ : Clutch engaged × : Clutch disengaged | | | | |
|---|---|---|---|---|---|
| Gear ratio switching hydraulic clutch (53) | × | ○ | × (○) | × | ○ |
| First shift switching hydraulic clutch (61) | × | × | × | ○ | ○ |
| Second shift switching hydraulic clutch (62) | ○ | ○ | × | × | × |
| One-way clutch (58) | Hinders reverse rotation | Permits forward rotation | Not actuated | Hinders reverse rotation | Permits forward rotation |
| Shift position | Low-speed forward | High-speed forward | Neutral | Low-speed reverse | High-speed reverse |

FIG. 6

BOAT PROPULSION SYSTEM, AND CONTROL DEVICE AND CONTROL METHOD THEREFOR

BACKGROUND OF THE INVENTION

1. Field of the Invention

The present invention relates to a boat propulsion system, and a control device and a control method therefor. More specifically, the present invention relates to a boat propulsion system including an electronically controlled shift mechanism, and a control device and a control method therefor.

2. Description of the Related Art

Conventionally a technique to drive a shift mechanism of an outboard motor using an electric actuator to switch the shift position has been disclosed in, for example, JP-A-2006-264361. In the shift mechanism disclosed in JP-A-2006-264361, the electric actuator engages and disengages a dog clutch to shift gears among forward, reverse, and neutral positions.

It is also known to provide low-speed and high-speed shift positions for each of forward and reverse directions. Specifically, it is known to provide five shift positions, namely low-speed forward, high-speed forward, neutral, low-speed reverse, and high-speed reverse.

A boat is accelerated and in some instances can be decelerated by the shift operations. In some instances, when the boat is to be decelerated or stopped, a gear shift is made to the opposite shift position to the current shift position to generate a propulsive force in the opposite direction to the traveling direction of the boat.

In the case where a gear shift is made to the direction opposite to the traveling direction, however, the rotational direction of a propeller shaft switches to a direction opposite to the direction it was traveling before the gear shift. Thus, a large load is applied to a power source and a power transmission mechanism of the boat at the time of the gear shift to the direction opposite to the traveling direction. In particular, when a gear shift is made to a high-speed forward or high-speed reverse position, a significantly large load is applied to the power source and the power transmission mechanism at the time of the gear shift to the opposite direction to the traveling direction.

SUMMARY OF THE INVENTION

In order to overcome the problems described above, preferred embodiments of the present invention provide a boat propulsion system including an electronically controlled shift mechanism in which a reduced load is applied to a power source and a power transmission mechanism when a gear shift to a direction opposite to the traveling direction is performed, in order to improve the durability and lifetime of the power source and the power transmission mechanism.

A preferred embodiment of the present invention provides a boat propulsion system including a power source, a boat propulsion section, a shift position switching mechanism, a gear ratio switching mechanism, an actuator, and a control section. The power source is arranged to generate a rotational force. The propulsion section has a propeller arranged to be driven by the rotational force. The propulsion section is arranged to generate a propulsive force. The shift position switching mechanism is disposed between the power source and the propulsion section. The shift position switching mechanism is arranged to switch among a first shift position, a second shift position, and a neutral position. In the second shift position, the rotational force of the power source is transmitted to the propulsion section as a rotational force in a direction opposite to that of the first shift position. In the neutral position, the rotational force of the power source is not transmitted to the propulsion section. The gear ratio switching mechanism is disposed between the power source and the propulsion section. The gear ratio switching mechanism is arranged to switch a gear ratio between the power source and the propulsion section between a low-speed gear ratio and a high-speed gear ratio. The actuator is arranged to drive the shift position switching mechanism and the gear ratio switching mechanism. The control section is arranged to control the actuator. The control section causes the actuator to maintain the low-speed gear ratio when the current gear ratio of the gear ratio switching mechanism is the low-speed gear ratio, then switch to the first shift position, and then establish the high-speed gear ratio when switching is to be performed from the neutral position to the first shift position and the high-speed gear ratio, and the control section causes the actuator to establish the low-speed gear ratio before switching to the first shift position, switch to the first shift position, and then establish the high-speed gear ratio when the current gear ratio of the gear ratio switching mechanism is the high-speed gear ratio.

A preferred embodiment of the present invention also provides a control device for a boat propulsion system including a power source, a boat propulsion section, a shift position switching mechanism, a gear ratio switching mechanism, and an actuator. The power source is arranged to generate a rotational force. The propulsion section has a propeller arranged to be driven by the rotational force. The propulsion section is arranged to generate a propulsive force. The shift position switching mechanism is disposed between the power source and the propulsion section. The shift position switching mechanism is arranged to switch between a first shift position, a second shift position, and a neutral position. In the second shift position, the rotational force of the power source is transmitted to the propulsion section as a rotational force in a direction opposite to that in the first shift position. In the neutral position, the rotational force of the power source is not transmitted to the propulsion section. The gear ratio switching mechanism is disposed between the power source and the propulsion section. The gear ratio switching mechanism is arranged to switch a gear ratio between the power source and the propulsion section between a low-speed gear ratio and a high-speed gear ratio. The actuator is arranged to drive the shift position switching mechanism and the gear ratio switching mechanism.

When switching is to be performed from the neutral position to the first shift position and the high-speed gear ratio, the control device for a boat propulsion system in accordance with a preferred embodiment of the present invention causes the actuator to maintain the low-speed gear ratio when the current gear ratio of the gear ratio switching mechanism is the low-speed gear ratio, switch to the first shift position, and then establish the high-speed gear ratio. Alternatively, when the current gear ratio of the gear ratio switching mechanism is the high-speed gear ratio, the control device causes the actuator to establish the low-speed gear ratio before switching to the first shift position, switch to the first shift position, and then establish the high-speed gear ratio.

A preferred embodiment of the present invention further provides a control method for a boat propulsion system including a power source, a boat propulsion section, a shift position switching mechanism, a gear ratio switching mechanism, and an actuator. The power source is arranged to generate a rotational force. The propulsion section has a propeller arranged to be driven by the rotational force. The propulsion section is arranged to generate a propulsive force. The shift position switching mechanism is disposed between the power source and the propulsion section. The shift position switching mechanism is arranged to switch between a first shift position, a second shift position, and a neutral position. In the second shift position, the rotational force of the power source is transmitted to the propulsion section as a rotational force in a direction opposite to that in the first shift position. In the neutral position, the rotational force of the power source is not transmitted to the propulsion section. The gear ratio switching mechanism is disposed between the power source and the propulsion section. The gear ratio switching mechanism switches a gear ratio between the power source and the propulsion section between a low-speed gear ratio and a high-speed gear ratio. The actuator drives the shift position switching mechanism and the gear ratio switching mechanism.

According to the control method for a boat propulsion system in accordance with this preferred embodiment of the present invention, the actuator is caused to maintain the low-speed gear ratio, switch to the first shift position, and then establish the high-speed gear ratio when switching is to be performed from the neutral position to the first shift position and the high-speed gear ratio when the current gear ratio of the gear ratio switching mechanism is the low-speed gear ratio, and the actuator is caused to establish the low-speed gear ratio before switching to the first shift position, switch to the first shift position, and then establish the high-speed gear ratio when the current gear ratio of the gear ratio switching mechanism is the high-speed gear ratio.

According to preferred embodiments of the present invention, the durability and lifetime of a power source and a power transmission mechanism can be improved in a boat propulsion system including an electronically controlled shift mechanism.

Other features, elements, steps, characteristics and advantages of the present invention will become more apparent from the following detailed description of preferred embodiments of the present invention with reference to the attached drawings.

BRIEF DESCRIPTION OF THE DRAWINGS

FIG. 6 is a table showing the engagement states of first to third hydraulic clutches and the shift position of the shift mechanism.

DETAILED DESCRIPTION OF THE PREFERRED EMBODIMENTS

Hereinafter, a description will be made of preferred embodiments of the present invention using an outboard motor 20 shown FIG. 1 as an example. It should be noted, however, that the preferred embodiments below are merely an illustration of one of the preferred embodiments of the present invention. Therefore, the present invention is not limited to the preferred embodiments below. The boat propulsion system in accordance with a preferred embodiment of the present invention may be a so-called inboard motor or a so-called stern drive, for example. The stern drive is also referred to as an inboard/outboard. The term "stern drive" refers to a boat propulsion system in which at least the power source is mounted on the hull. The "stern drive" also includes a boat propulsion system in which components other than the propulsion section are mounted on the hull.

First Preferred Embodiment

Figure 1:
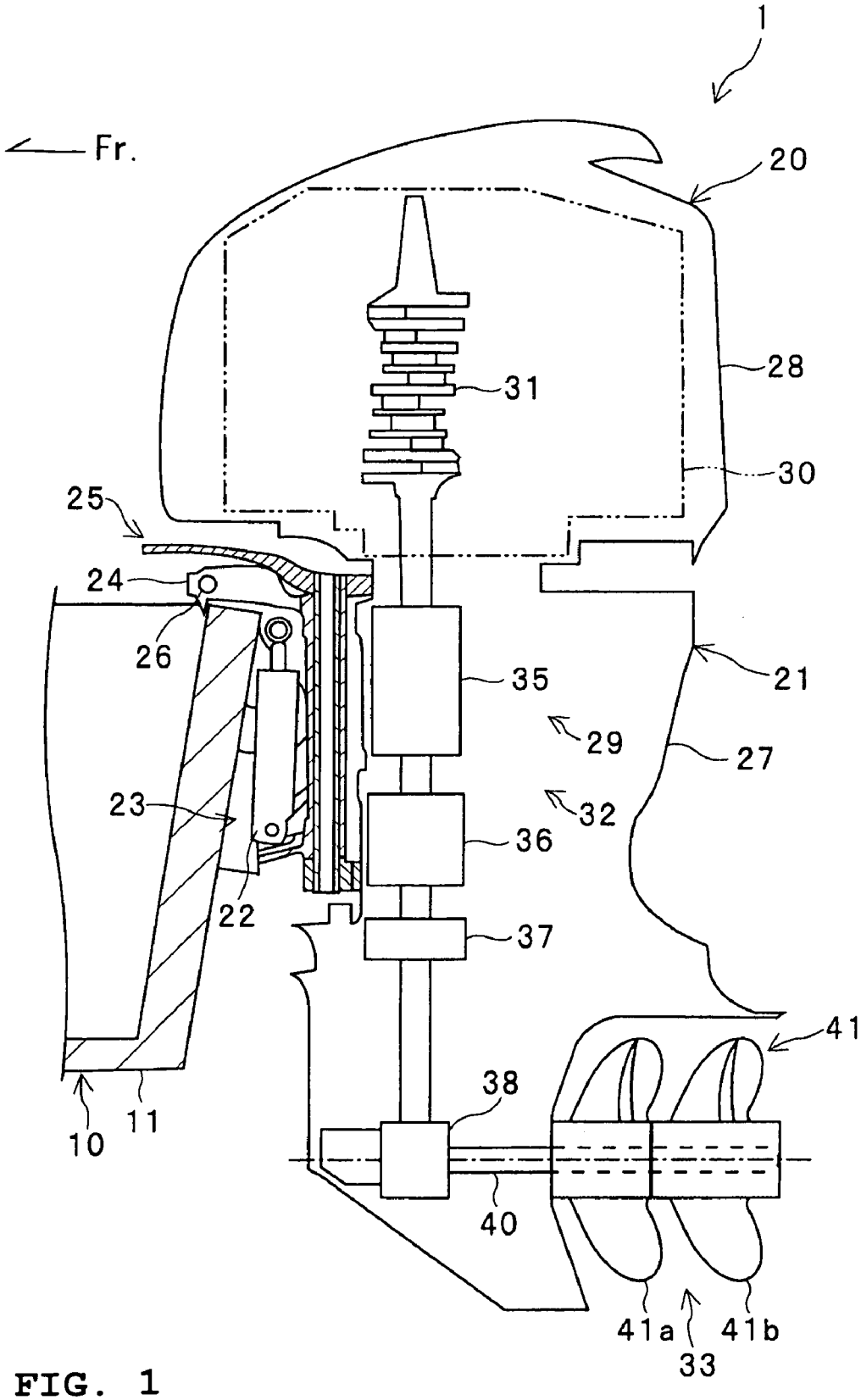
FIG. 1 is a partial cross-sectional view of the stern portion of a boat in accordance with a first preferred embodiment of the present invention as viewed from a side.

FIG. 1 is a partial cross sectional view of a stern 11 portion of a boat 1 in accordance with a first preferred embodiment as viewed from a side. As shown in FIG. 1, the boat 1 includes a hull 10 and an outboard motor 20 defining a boat propulsion system. The outboard motor 20 is preferably attached to the stern 11 of the hull 10.

Schematic Configuration of Outboard Motor 20

The outboard motor 20 preferably includes an outboard motor main unit 21, a tilt/trim mechanism 22, and a bracket 23.

The bracket 23 preferably includes a mount bracket 24 and a swivel bracket 25. The mount bracket 24 is fixed to the hull 10 by screws (not shown), for example.

The swivel bracket 25 is supported by the mount bracket 24 through a pivot shaft 26. The swivel bracket 25 is pivotable vertically about the central axis of the pivot shaft 26. The outboard motor main unit 21 is preferably a so-called rubber-mounted on the swivel bracket 25.

The tilt/trim mechanism 22 is arranged to perform tilt and trim operations of the outboard motor main unit 21.

The outboard motor main unit 21 includes a casing 27, a cowling 28, and a propulsive force generation device 29. Most portions of the propulsive force generation device 29 are disposed inside the casing 27 and the cowling 28.

Figure 2:
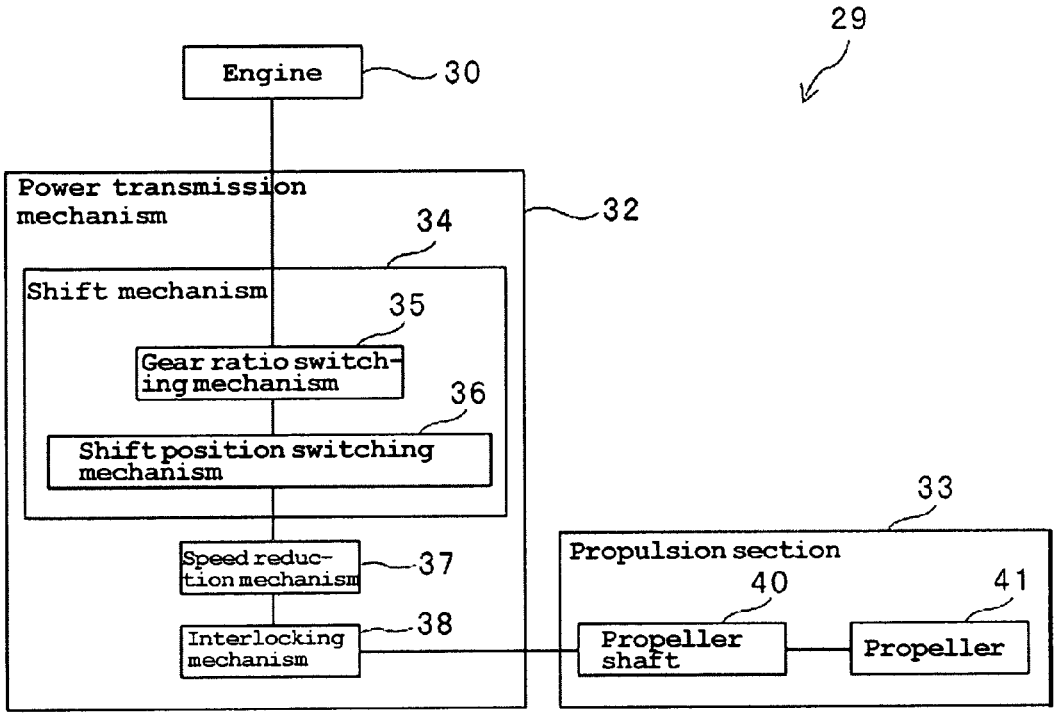
FIG. 2 is a schematic configuration diagram showing the configuration of a propulsive force generation device in accordance with the first preferred embodiment of the present invention.

As shown in FIGS. 1 and 2, the propulsive force generation device 29 includes an engine 30, a power transmission mechanism 32, and a propulsion section 33.

In this preferred embodiment, the outboard motor 20 has the engine 30 as a power source. It should be noted, however, that the power source is not specifically limited this, and any desirable power source could be used so long as it can generate a rotational force. For example, the power source may be an electric motor.

Figure 5:
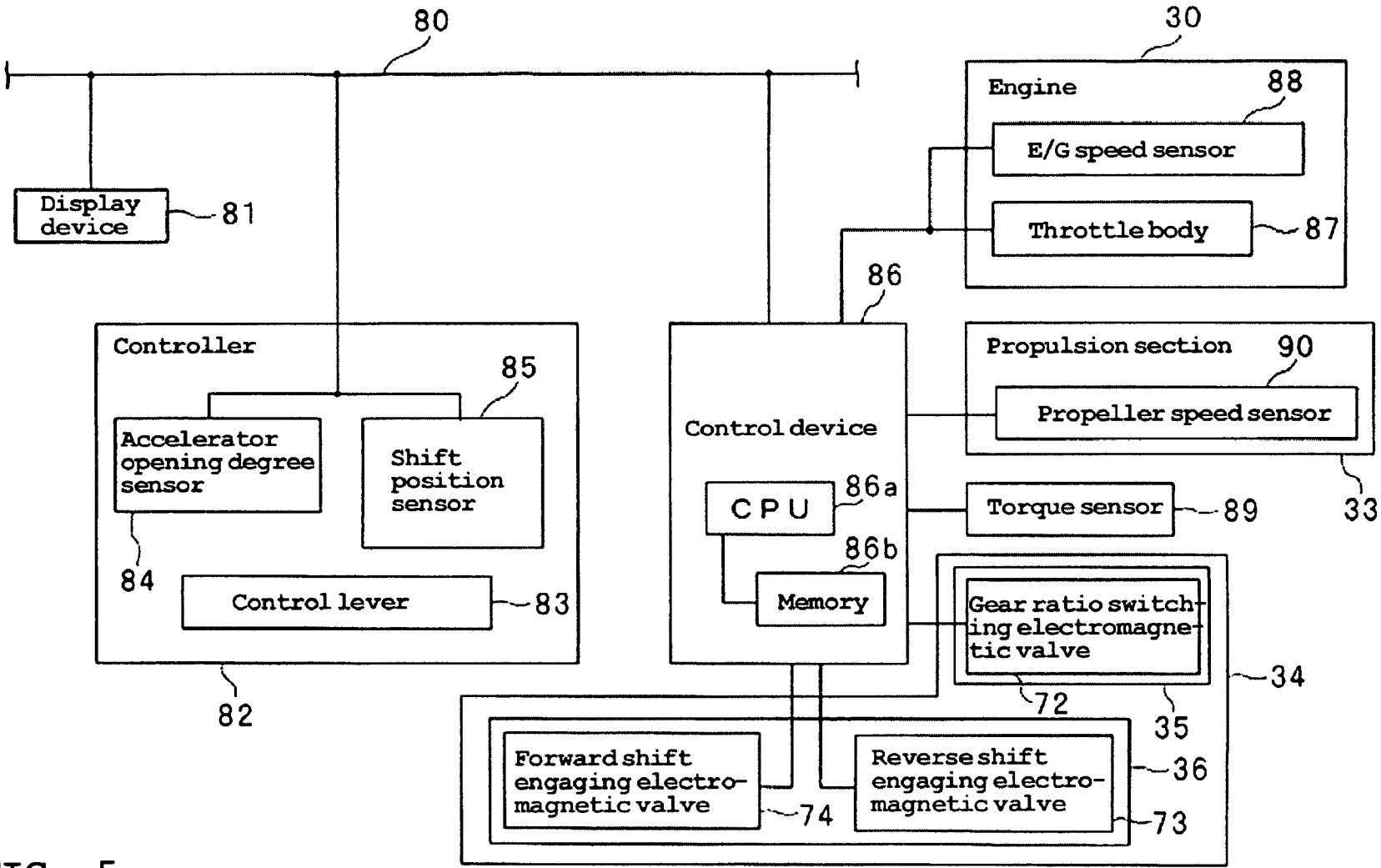
FIG. 5 is a diagram showing the control block of the boat.

The engine 30 is preferably a fuel injection engine having a throttle body 87 (shown in FIG. 5). The engine 30 generates a rotational force. As shown in FIG. 1, the engine 30 includes a crankshaft 31. The engine 30 outputs the generated rotational force through the crankshaft 31.

The power transmission mechanism 32 is disposed between the engine 30 and the propulsion section 33. The power transmission mechanism 32 transmits the rotational force generated by the engine 30 to the propulsion section 33. The power transmission mechanism 32 preferably includes a shift mechanism 34, a speed reduction mechanism 37, and an interlocking mechanism 38.

The shift mechanism 34 is connected to the crankshaft 31 of the engine 30. As shown in FIG. 2, the shift mechanism 34 includes a gear ratio switching mechanism 35 and a shift position switching mechanism 36.

The gear ratio switching mechanism 35 is arranged to switch the gear ratio between the engine 30 and the propulsion section 33 between a high-speed gear ratio (HIGH) and a low-speed gear ratio (LOW). Here, the term "high-speed gear ratio" refers to a gear ratio at which the ratio of the output rotational speed to the input rotational speed is relatively large. On the other hand, the term "low-speed gear ratio" refers to a gear ratio at which the ratio of the output rotational speed to the input rotational speed is relatively small.

The shift position switching mechanism 36 switches the shift position among forward, reverse, and neutral positions.

The speed reduction mechanism 37 is connected to the shift mechanism 34. The speed reduction mechanism 37 reduces, and transmits to the propulsion section 33 side, the rotational force from the shift mechanism 34. The structure of the speed reduction mechanism 37 is not specifically limited. For example, the speed reduction mechanism 37 may have a planetary gear mechanism. Alternatively, the speed reduction mechanism 37 may have a pair of speed reduction gears.

The interlocking mechanism 38 is disposed between the speed reduction mechanism 37 and the propulsion section 33. The interlocking mechanism 38 includes a set of bevel gears (not shown). The interlocking mechanism 38 changes the direction of, and transmits to the propulsion section 33, the rotational force from the speed reduction mechanism 37.

The propulsion section 33 includes a propeller shaft 40 and a propeller 41. The propeller shaft 40 transmits the rotational force from the interlocking mechanism 38 to the propeller 41. The propulsion section 33 is arranged to convert the rotational force generated by the engine 30 into a propulsive force.

As shown in FIG. 1, the propeller 41 preferably includes two propellers, namely a first propeller 41*a* and a second propeller 41*b*. A spiraling direction of the first propeller 41*a* is opposite to a spiraling direction of the second propeller 41*b*. When the rotational force output from the power transmission mechanism 32 is in the forward direction, the first propeller 41*a* and the second propeller 41*b* rotate in opposite directions to each other, thus generating a propulsive force in the forward direction. The forward shift position is thus established. On the other hand, when the rotational force output from the power transmission mechanism 32 is in the reverse direction, the first propeller 41*a* and the second propeller 41*b* respectively rotate in the opposite directions to the directions in which they rotate when generating a propulsive force in the forward direction, thus generating a propulsive force in the reverse direction. The reverse shift position is thus established.

Detailed Structure of Shift Mechanism 34

Figure 3:
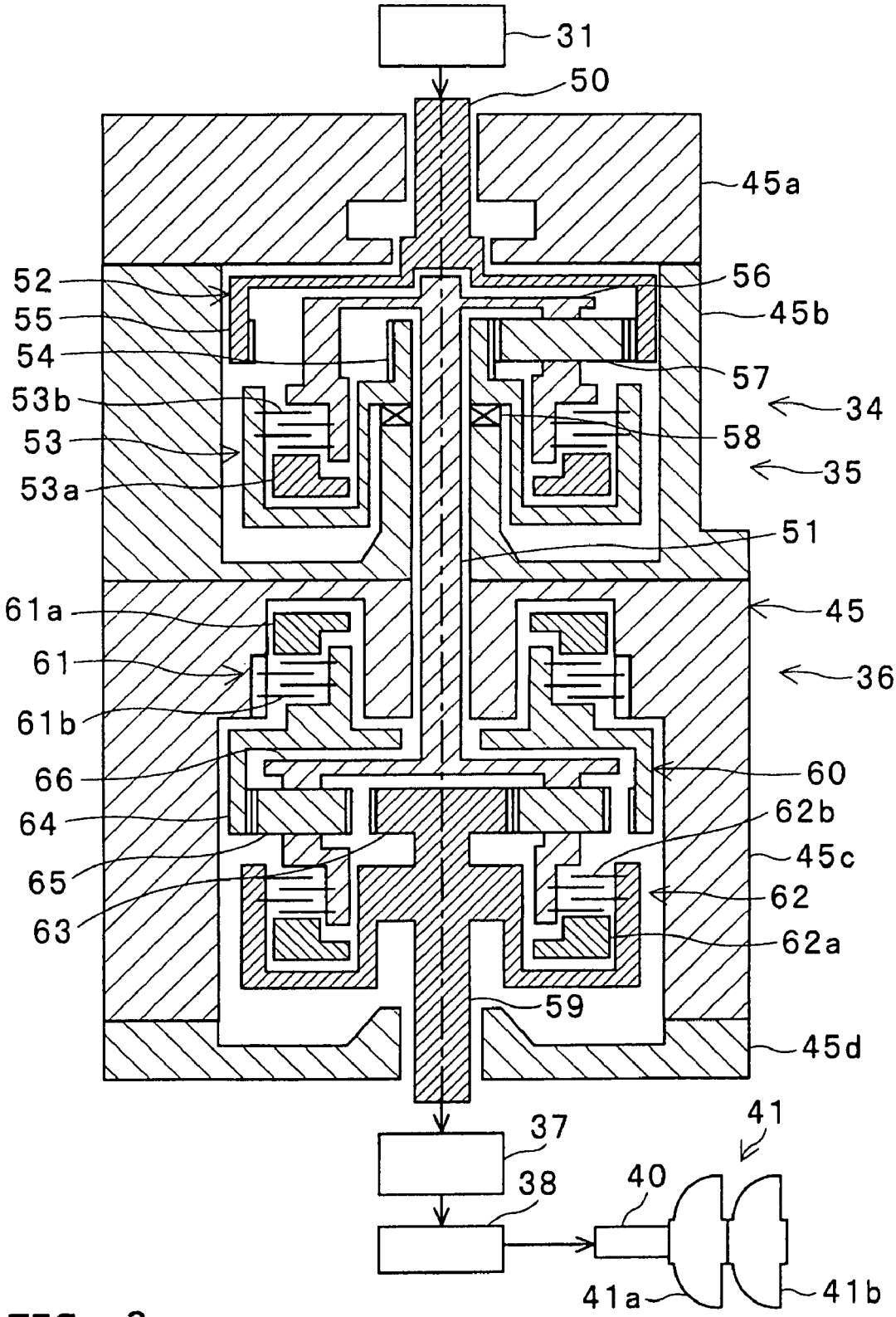
FIG. 3 is a schematic cross-sectional view of a shift mechanism in accordance with the first preferred embodiment of the present invention.

Now, a detailed description will be provided of the structure of the shift mechanism 34 in accordance with this preferred embodiment mainly with reference to FIG. 3. It should be noted, however, that the configuration of the shift mechanism 34 shown in FIG. 3 is merely illustrative. In the present invention, the shift mechanism is not limited to the shift mechanism 34 shown in FIG. 3. FIG. 3 shows a schematic illustration of the shift mechanism 34. Therefore, the structure of the shift mechanism 34 shown in FIG. 3 may not exactly coincide with the actual structure of the shift mechanism 34.

The shift mechanism 34 includes a shift case 45. The shift case 45, as it appears, has a generally columnar shape. The shift case 45 includes a first case 45*a*, a second case 45*b*, a third case 45*c*, and a fourth case 45*d*. The first case 45*a*, the second case 45*b*, the third case 45*c*, and the fourth case 45*d* are fixed to each other by bolts or other fastening or fixing elements or materials.

Gear Ratio Switching Mechanism 35

The gear ratio switching mechanism 35 includes a first power transmission shaft 50 as an input shaft, a second power transmission shaft 51 as an output shaft, a planetary gear mechanism 52, and a gear ratio switching hydraulic clutch 53. The first power transmission shaft 50 and the second power transmission shaft 51 are disposed coaxially or substantially coaxially with each other. The first power transmission shaft 50 is rotatably supported by the first case 45*a*. The second power transmission shaft 51 is rotatably supported by the second case 45*b* and the third case 45*c*. The first power transmission shaft 50 is connected to the crankshaft 31. The first power transmission shaft 50 is also connected to the planetary gear mechanism 52.

The planetary gear mechanism 52 includes a sun gear 54, a ring gear 55, a carrier 56, and a plurality of planetary gears 57. The ring gear 55 preferably has a generally cylindrical shape. Teeth that mesh with the planetary gears 57 are provided on the inner peripheral surface of the ring gear 55. The ring gear 55 is connected to the first power transmission shaft 50. The ring gear 55 rotates together with the first power transmission shaft 50.

The sun gear 54 is disposed inside the ring gear 55. The sun gear 54 and the ring gear 55 rotate about the same axis as each other. The sun gear 54 is attached to the second case 45*b* via a one-way clutch 58. The one-way clutch 58 permits rotation in the forward direction but restricts rotation in the reverse direction. Therefore, the sun gear 54 can rotate in the forward direction but cannot rotate in the reverse direction.

The plurality of planetary gears 57 are disposed between the sun gear 54 and the ring gear 55. Each of the planetary gears 57 is meshed with both the sun gear 54 and the ring gear 55. Each of the planetary gears 57 is rotatably supported by the carrier 56. Therefore, the plurality of planetary gears 57 revolve around the axis of the first power transmission shaft 50 at the same speed as each other while rotating about their own axes.

The term "rotate" as used herein refers to movement of a member to turn about an axis located inside that member. Meanwhile, the term "revolve" refers to movement of a member to turn around an axis located outside that member.

The carrier 56 is connected to the second power transmission shaft 51. The carrier 56 rotates together with the second power transmission shaft 51.

The gear ratio switching hydraulic clutch 53 is disposed between the carrier 56 and the sun gear 54. In this preferred embodiment, the gear ratio switching hydraulic clutch 53 is preferably a wet-type multi-plate clutch. It should be noted, however, that the gear ratio switching hydraulic clutch 53 is not limited to a wet-type multi-plate clutch in the present invention. The gear ratio switching hydraulic clutch 53 may be a dry-type multi-plate clutch or a so-called dog clutch, for example.

The term "multi-plate clutch" as used herein refers to a clutch which includes a first member and a second member that are rotatable relative to each other, one or a plurality of first plates that rotate together with the first member, and one or a plurality of second plates that rotate together with the second member, and which restricts rotation between the first member and the second member when the first plates and the second plates are compressed against each other. The term "clutch" as used herein is not limited to a component which is disposed between an input shaft that receives a rotational force and an output shaft that outputs a rotational force and which engages and disengages the input shaft and the output shaft.

The gear ratio switching hydraulic clutch 53 includes a hydraulic piston 53*a* and a group of plates 53*b* including clutch plates and friction plates. When the piston 53*a* is driven, the group of plates 53*b* are brought into the compressed state. This brings the gear ratio switching hydraulic clutch 53 into the engaged state. On the other hand, when the piston 53*a* is not driven, the group of plates 53*b* are brought into the uncompressed state. This brings the gear ratio switching hydraulic clutch 53 into the disengaged state.

When the gear ratio switching hydraulic clutch 53 is brought into the engaged state, the sun gear 54 and the carrier 56 are fixed to each other. Therefore, as the planetary gears 57 revolve, the sun gear 54 and the carrier 56 rotate integrally with each other.

Shift Position Switching Mechanism 36

The shift position switching mechanism 36 includes the second power transmission shaft 51 as an input shaft, a third power transmission shaft 59 as an output shaft, a planetary gear mechanism 60, a first shift switching hydraulic clutch 61, and a second shift switching hydraulic clutch 62.

The first shift switching hydraulic clutch 61 and the second shift switching hydraulic clutch 62 are arranged to change the engagement state between the second power transmission shaft 51 as an input shaft and the third power transmission shaft 59 as an output shaft.

The third power transmission shaft 59 is rotatably supported by the third case 45*c* and the fourth case 45*d*. The second power transmission shaft 51 and the third power transmission shaft 59 are disposed coaxially with each other. In this preferred embodiment, the hydraulic clutches 61 and 62 are preferably each a wet-type multi-plate clutch. The second power transmission shaft 51 is common to the gear ratio switching mechanism 35 and the shift position switching mechanism 36.

The shift position switching mechanism 36 switches among the forward position as a second shift position, the reverse position as a first shift position, and the neutral position, as discussed in detail below. In the forward position, the first shift switching hydraulic clutch 61 is disengaged, while the second shift switching hydraulic clutch 62 is engaged. In the forward position, the rotational force generated by the engine 30 is output from the shift position switching mechanism 36 as a rotational force in the forward direction. In the reverse position, the first shift switching hydraulic clutch 61 is engaged, while the second shift switching hydraulic clutch 62 is disengaged. In the reverse position, the rotational force generated by the engine 30 is output from the shift position switching mechanism 36 as a rotational force in the reverse direction. In the neutral position, both the first and second hydraulic clutches 61 and 62 are disengaged. In the neutral position, the rotational force generated by the engine 30 is not output from the shift position switching mechanism 36. That is, the rotational force generated by the engine 30 is not transmitted to the propulsion section 33.

The planetary gear mechanism 60 includes a sun gear 63, a ring gear 64, a plurality of planetary gears 65, and a carrier 66.

The carrier 66 is connected to the second power transmission shaft 51. The carrier 66 rotates together with the second power transmission shaft 51. Therefore, as the second power transmission shaft 51 rotates, the carrier 66 rotates, and the plurality of planetary gears 65 revolve at the same speed as each other.

The plurality of planetary gears 65 are meshed with the ring gear 64 and the sun gear 63. The first shift switching hydraulic clutch 61 is disposed between the ring gear 64 and the third case 45*c*. The first shift switching hydraulic clutch 61 includes a hydraulic piston 61*a* and a group of plates 61*b* including clutch plates and friction plates. When the hydraulic piston 61*a* is driven, the group of plates 61*b* are brought into the compressed state. This brings the first shift switching hydraulic clutch 61 into the engaged state. As a result, the ring gear 64 becomes fixed, and unable to rotate, relative to the third case 45*c*. On the other hand, when the hydraulic piston 61*a* is not driven, the group of plates 61*b* are brought into the uncompressed state. This brings the first shift switching hydraulic clutch 61 into the disengaged state. As a result, the ring gear 64 becomes unfixed, and able to rotate, relative to the third case 45*c*.

The second shift switching hydraulic clutch 62 is disposed between the carrier 66 and the sun gear 63. The second shift switching hydraulic clutch 62 includes a hydraulic piston 62*a* and a group of plates 62*b* including clutch plates and friction plates. When the hydraulic piston 62*a* is driven, the group of plates 62*b* are brought into the compressed state. This brings the second shift switching hydraulic clutch 62 into the engaged state. As a result, the carrier 66 and the sun gear 63 rotate integrally with each other. On the other hand, when the hydraulic piston 62*a* is not driven, the group of plates 62*b* are brought into the uncompressed state. This brings the second shift switching hydraulic clutch 62 into the disengaged state. As a result, the ring gear 64 and the sun gear 63 become rotatable relative to each other.

Figure 4:
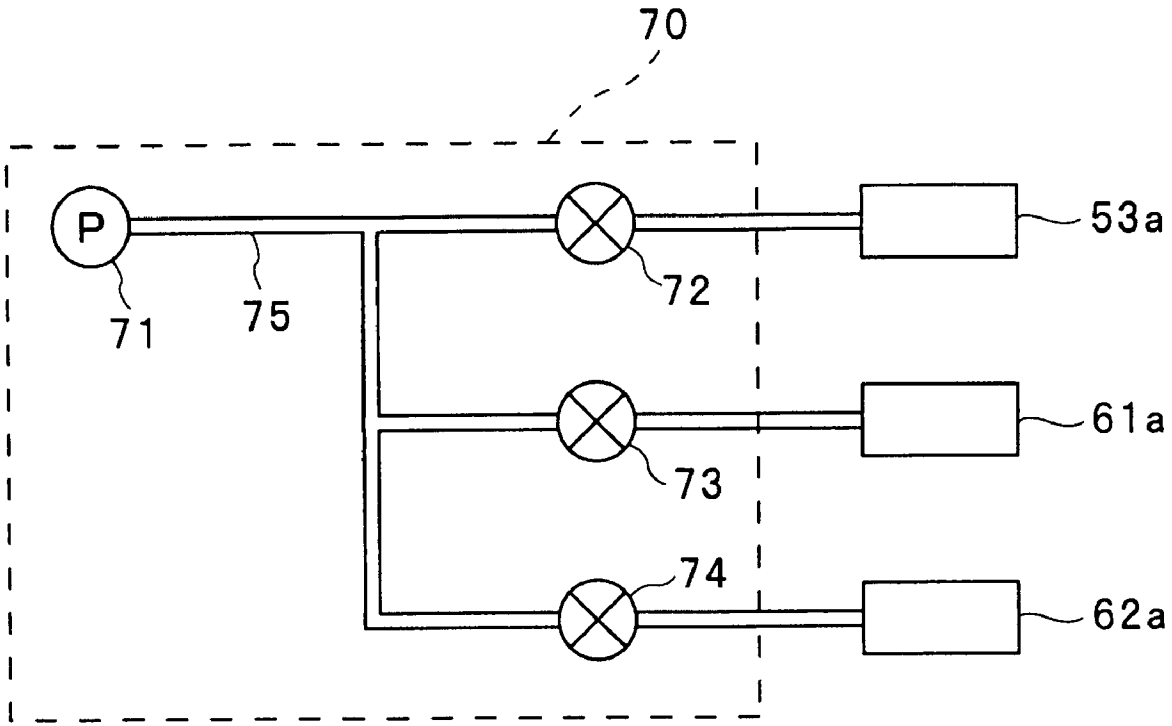
FIG. 4 is an oil circuit diagram in accordance with the first preferred embodiment of the present invention.

As shown in FIG. 4, the hydraulic pistons 53*a*, 61*a*, and 62*a* are driven by an actuator 70. The actuator 70 preferably includes an oil pump 71, a gear ratio switching electromagnetic valve 72, a reverse shift engaging electromagnetic valve 73, and a forward shift engaging electromagnetic valve 74. The oil pump 71 is connected to the hydraulic pistons 53*a*, 61*a*, 62*a* by way of an oil path 75. The gear ratio switching electromagnetic valve 72 is disposed between the oil pump 71 and the hydraulic piston 53*a*. The gear ratio switching electromagnetic valve 72 is used to adjust the hydraulic pressure of the hydraulic piston 53*a*. The reverse shift engaging electromagnetic valve 73 is disposed between the oil pump 71 and the hydraulic piston 61*a*. The reverse shift engaging electromagnetic valve 73 is used to adjust the hydraulic pressure of the hydraulic piston 61*a*. The forward shift engaging electromagnetic valve 74 is disposed between the oil pump 71 and the hydraulic piston 62*a*. The forward shift engaging electromagnetic valve 74 is used to adjust the hydraulic pressure of the hydraulic piston 62*a*.

Each of the gear ratio switching electromagnetic valve 72, the reverse shift engaging electromagnetic valve 73, and the forward shift engaging electromagnetic valve 74 can gradually change the path area of the oil path 75. Therefore, the pressing forces of the hydraulic pistons 53*a*, 61*a*, 62*a* can be gradually changed using the gear ratio switching electromagnetic valve 72, the reverse shift engaging electromagnetic valve 73, and the forward shift engaging electromagnetic valve 74. Thus, the engagement forces of the hydraulic clutches 53, 61 and 62 can be gradually changed.

Specifically, in this preferred embodiment, each of the gear ratio switching electromagnetic valve 72, the reverse shift engaging electromagnetic valve 73, and the forward shift engaging electromagnetic valve 74 preferably includes a solenoid valve controlled by pulse width modulation (PWM). It should be noted, however, that each of the gear ratio switching electromagnetic valve 72, the reverse shift engaging electromagnetic valve 73, and the forward shift engaging electromagnetic valve 74 may include a valve other than a PWM-controlled solenoid valve. For example, each of the gear ratio switching electromagnetic valve 72, the reverse shift engaging electromagnetic valve 73, and the forward shift engaging electromagnetic valve 74 may include an on-off controlled solenoid valve.

The engagement force of a clutch is a value representing the engagement state of the clutch. That is, the phrase "the engagement force of the gear ratio switching hydraulic clutch 53 is 100%", for example, means that the hydraulic piston 53*a* is driven to bring the group of plates 53*b* into the completely compressed state and that the gear ratio switching hydraulic clutch 53 is completely engaged. On the other hand, the phrase "the engagement force of the gear ratio switching hydraulic clutch 53 is 0%", for example, means that the hydraulic piston 53*a* is not driven to bring the group of plates 53*b* into the uncompressed state with the plates separated from each other and that the gear ratio switching hydraulic clutch 53 is completely disengaged. Moreover, the phrase "the engagement force of the gear ratio switching hydraulic clutch 53 is 80%", for example, means that the gear ratio switching hydraulic clutch 53 is driven to bring the group of plates 53*b* into a compressed state to establish a so-called half-clutch state in which the drive torque transmitted from the first power transmission shaft 50 as an input shaft to the second power transmission shaft 51 as an output shaft, or the rotational speed of the second power transmission shaft 51, is 80% that achieved when the gear ratio switching hydraulic clutch 53 is completely engaged.

Gear Shift Operation of Shift Mechanism 34

Now, a detailed description will be made of the gear shift operation of the shift mechanism 34 mainly with reference to FIGS. 3 and 6. FIG. 6 is a table showing the engagement states of the hydraulic clutches 53, 61 and 62 and the shift position of the shift mechanism 34. The shift position of the shift mechanism 34 is switched by engaging and disengaging the first to third hydraulic clutches 53, 61 and 62.

Switching Between Low-Speed Gear Ratio and High-Speed Gear Ratio

The gear ratio switching mechanism 35 switches between the low-speed gear ratio and the high-speed gear ratio. Specifically, the gear ratio switching hydraulic clutch 53 is operated to switch between the low-speed gear ratio and the high-speed gear ratio. More specifically, when the gear ratio switching hydraulic clutch 53 is in the disengaged state, the "low-speed gear ratio" is established. On the other hand, when the gear ratio switching hydraulic clutch 53 is in the engaged state, the "high-speed gear ratio" is established.

As shown in FIG. 3, the ring gear 55 is connected to the first power transmission shaft 50. Therefore, as the first power transmission shaft 50 rotates, the ring gear 55 rotates in the forward direction. Here, when the gear ratio switching hydraulic clutch 53 is in the disengaged state, the carrier 56 and the sun gear 54 are rotatable relative to each other. Hence, the planetary gears 57 revolve while rotating. As a result, the sun gear 54 comes close to rotating in the reverse direction.

However, as shown in FIG. 6, the one-way clutch 58 hinders rotation of the sun gear 54 in the reverse direction. Therefore, the sun gear 54 is fixed by the one-way clutch 58. As a result, as the ring gear 55 rotates, the planetary gears 57 revolve between the sun gear 54 and the ring gear 55, which causes the second power transmission shaft 51 to rotate together with the carrier 56. In this case, since the planetary gears 57 rotate while revolving, the rotation of the first power transmission shaft 50 is reduced and transmitted to the second power transmission shaft 51. Thus, the "low-speed gear ratio" is established.

On the other hand, when the gear ratio switching hydraulic clutch 53 is in the engaged state, the planetary gears 57 and the sun gear 54 rotate integrally with each other. Hence, rotation of the planetary gears 57 is prohibited. Thus, as the ring gear 55 rotates, the planetary gears 57, the carrier 56, and the sun gear 54 rotate in the forward direction at the same rotational speed as that of the ring gear 55. Here, as shown in FIG. 6, the one-way clutch 58 permits rotation of the sun gear 54 in the forward direction. As a result, the first power transmission shaft 50 and the second power transmission shaft 51 rotate in the forward direction at the same rotational speed as each other. In other words, the rotational force of the first power transmission shaft 50 is transmitted to the second power transmission shaft 51 at the same rotational speed and in the same rotational direction. Thus, the "high-speed gear ratio" is established.

Switching Between Forward, Reverse and Neutral Positions

The shift position switching mechanism 36 switches among the forward, reverse, and neutral positions. Specifically, the first shift switching hydraulic clutch 61 and the second shift switching hydraulic clutch 62 are operated to switch among the forward, reverse, and neutral positions.

The "forward" position is established when the first shift switching hydraulic clutch 61 is in the disengaged state while the second shift switching hydraulic clutch 62 is in the engaged state. When the first shift switching hydraulic clutch 61 is in the disengaged state, the ring gear 64 is rotatable relative to the shift case 45. When the second shift switching hydraulic clutch 62 is in the engaged state, the carrier 66, the sun gear 63, and the third power transmission shaft 59 rotate integrally with each other. Therefore, when the first shift switching hydraulic clutch 61 is in the engaged state while the second shift switching hydraulic clutch 62 is in the engaged state, the second power transmission shaft 51, the carrier 66, the sun gear 63, and the third power transmission shaft 59 rotate integrally with each other in the forward direction. Thus, the "forward" shift position is established.

The "reverse" position is established when the first shift switching hydraulic clutch 61 is in the engaged state while the second shift switching hydraulic clutch 62 is in the disengaged state. When the first shift switching hydraulic clutch 61 is in the engaged state while the second shift switching hydraulic clutch 62 is in the disengaged state, rotation of the ring gear 64 is restricted by the shift case 45. On the other hand, the sun gear 63 is rotatable relative to the carrier 66. Thus, as the second power transmission shaft 51 rotates in the forward direction, the planetary gears 65 revolve while rotating. As a result, the sun gear 63 and the third power transmission shaft 59 rotate in the reverse direction. Thus, the "reverse" shift position is established.

The "neutral" position is established when both the first shift switching hydraulic clutch 61 and the second shift switching hydraulic clutch 62 are in the disengaged state. When both the first shift switching hydraulic clutch 61 and the second shift switching hydraulic clutch 62 are in the disengaged state, the planetary gear mechanism 60 is idle. Therefore, rotation of the second power transmission shaft 51 is not transmitted to the third power transmission shaft 59. Thus, the "neutral" shift position is established.

Switching between the low-speed gear ratio and the high-speed gear ratio and switching among the shift positions are performed as described above. Thus, as shown in FIG. 6, when the gear ratio switching hydraulic clutch 53 and the first shift switching hydraulic clutch 61 are in the disengaged state while the second shift switching hydraulic clutch 62 is in the engaged state, the "low-speed forward" shift position is established. When the gear ratio switching hydraulic clutch 53 and the second shift switching hydraulic clutch 62 are in the engaged state while the first shift switching hydraulic clutch 61 is in the disengaged state, the "high-speed forward" shift position is established. When both the first shift switching hydraulic clutch 61 and the second shift switching hydraulic clutch 62 are in the disengaged state, the "neutral" position is established irrespective of the engagement state of the gear ratio switching hydraulic clutch 53. When the gear ratio switching hydraulic clutch 53 and the second shift switching hydraulic clutch 62 are in the disengaged state while the first shift switching hydraulic clutch 61 is in the engaged state, the "low-speed reverse" shift position is established. When the gear ratio switching hydraulic clutch 53 and the first shift switching hydraulic clutch 61 are in the engaged state while the second shift switching hydraulic clutch 62 is in the disengaged state, the "high-speed reverse" shift position is established.

Control Block of Outboard Motor 1

Now, a description will be made of the control block of the boat 1 mainly with reference to FIG. 5.

First, a description will be made of the control block of the outboard motor 20 with reference to FIG. 5. The outboard motor 20 is provided with a control device 86. The control device 86 is arranged to control various mechanisms of the outboard motor 20. The control device 86 includes a central processing unit (CPU) 86*a* as a computation section and a memory 86*b*. The memory 86*b* stores various settings such as maps to be discussed below. The memory 86*b* is connected to the CPU 86*a*. When the CPU 86*a* performs various calculations, it reads out necessary information stored in the memory 86*b*. As needed, the CPU 86*a* outputs computation results to the memory 86*b* and causes the memory 86*b* to store the computation results.

A throttle body 87 of the engine 30 is connected to the control device 86. The throttle body 87 is controlled by the control device 86, thus controlling the rotational speed of the engine 30. As a result, the output of the engine 30 is controlled.

An engine speed sensor 88 is also connected to the control device 86. The engine speed sensor 88 is arranged to detect the rotational speed of the crankshaft 31 of the engine 30 shown in FIG. 1. The engine speed sensor 88 then outputs the detected engine speed to the control device 86.

A torque sensor 89 is provided between the engine 30 and the propeller 41. The torque sensor 89 detects a torque generated between the engine 30 and the propeller 41. The torque sensor 89 outputs the detected torque to the control device 86.

The torque sensor 89 may be disposed at any position between the engine 30 and the propeller 41. For example, the torque sensor 89 may be disposed at the crankshaft 31, the first to third power transmission shafts 50, 51, 59, the propeller shaft 40, etc. The torque sensor 89 may include a magnetostrictive sensor, for example.

The propulsion section 33 is provided with a propeller speed sensor 90. The propeller speed sensor 90 is arranged to detect the rotational speed of the propeller 41. The propeller speed sensor 90 then outputs the detected rotational speed to the control device 86. The rotational speed of the propeller 41 is substantially the same as that of the propeller shaft 40. Thus, the propeller speed sensor 90 may detect the rotational speed of the propeller shaft 40.

The gear ratio switching electromagnetic valve 72, the forward shift engaging electromagnetic valve 74, and the reverse shift engaging electromagnetic valve 73 described above are connected to the control device 86. The control device 86 is arranged to control opening and closing and the opening degrees of the gear ratio switching electromagnetic valve 72, the forward shift engaging electromagnetic valve 74, and the reverse shift engaging electromagnetic valve 73 described above.

As shown in FIG. 5, the boat 1 includes a local area network (LAN) 80 installed over the hull 10. In the boat 1, signals are transmitted and received between devices via the LAN 80.

The control device 86 of the outboard motor 20, a controller 82, and a display device 81 are preferably connected to the LAN 80. The control device 86 outputs the detected engine speed, propeller speed, etc. The display device 81 displays information output from the control device 86 and information output from the controller 82 to be discussed below. Specifically, the display device 81 displays the current speed of the boat 1, shift position, etc.

The controller 82 preferably includes a control lever 83, an accelerator opening degree sensor 84, and a shift position sensor 85 as a shift position detection section. The shift position and the accelerator opening degree are input to the control lever 83 by operations of a boat operator of the boat 1. Specifically, when the boat operator operates the control lever 83, the accelerator opening degree sensor 84 and the shift position sensor 85 detect the accelerator opening degree and the shift position, respectively, in accordance with the state of the control lever 83. Each of the accelerator opening degree sensor 84 and the shift position sensor 85 are connected to the LAN 80. The accelerator opening degree sensor 84 and the shift position sensor 85 transmit the accelerator opening degree and the shift position, respectively, to the LAN 80.

The control device 86 receives via the LAN 80 an accelerator opening degree signal and a shift position signal output from the accelerator opening degree sensor 84 and the shift position sensor 85, respectively.

Control of Boat 1

Now, a description will be made of the control of the boat 1.

Basic Control of Boat 1

When the control lever 83 is operated by the boat operator of the boat 1, the accelerator opening degree sensor 84 and the shift position sensor 85 detect the accelerator opening degree and the shift position, respectively, in accordance with the state of the control lever 83. The detected accelerator opening degree and shift position are transmitted to the LAN 80. The control device 86 receives an accelerator opening degree signal and a shift position signal output via the LAN 80. The control device 86 controls the throttle body 87 according to the accelerator opening degree signal. The control device 86 thus performs output control of the engine 30.

The control device 86 also controls the shift mechanism 34 according to the shift position signal. Specifically, in the case where a "low-speed forward" shift position signal is received, the control device 86 drives the gear ratio switching electromagnetic valve 72 to disengage the gear ratio switching hydraulic clutch 53, and drives the shift engaging electromagnetic valves 73, 74 to disengage the first shift switching hydraulic clutch 61 and engage the second shift switching hydraulic clutch 62. The shift position is thus switched to the "low-speed forward" position.

Specific Control of Boat 1

(1) Retention of low-speed gear ratio, shift-in prohibition period.

In this preferred embodiment, when a gear shift is to be made from the neutral position to the high-speed forward or high-speed reverse position, the gear ratio of the gear ratio switching mechanism 35 is changed to the low-speed gear ratio before the shift position switching mechanism 36 makes a gear shift to the forward or reverse position to minimize the load applied to the power source and the power transmission mechanism and minimize forces applied to the occupants of the boat. After that, a gear shift from the neutral position to the forward or reverse position is started. After that, the gear ratio of the gear ratio switching mechanism 35 is switched to the high-speed gear ratio. That is, a gear shift from the neutral position to the forward or reverse position is started with the gear ratio of the gear ratio switching mechanism 35 in the low-speed gear ratio. After that, the gear ratio of the gear ratio switching mechanism 35 is switched from the low-speed gear ratio to the high-speed gear ratio.

Moreover, in this preferred embodiment, the control device 86 shown in FIG. 5 prohibits a gear shift to one of the forward and reverse positions until a predetermined shift-in prohibition period elapses after a gear shift from any of the forward, reverse, and neutral positions to the forward or reverse position is made. That is, in this preferred embodiment, a gear shift between the forward and reverse positions is prohibited during the shift-in prohibition period. It should be noted, however, that a gear shift from the forward or reverse position to the neutral position is not necessarily prohibited. The shift-in prohibition period may be set appropriately according to the characteristics of the outboard motor 20, etc. For example, the shift-in prohibition period may be set to about 0.1 seconds to about 10 seconds, preferably about 0.2 seconds to about 1 second.

Figure 8:
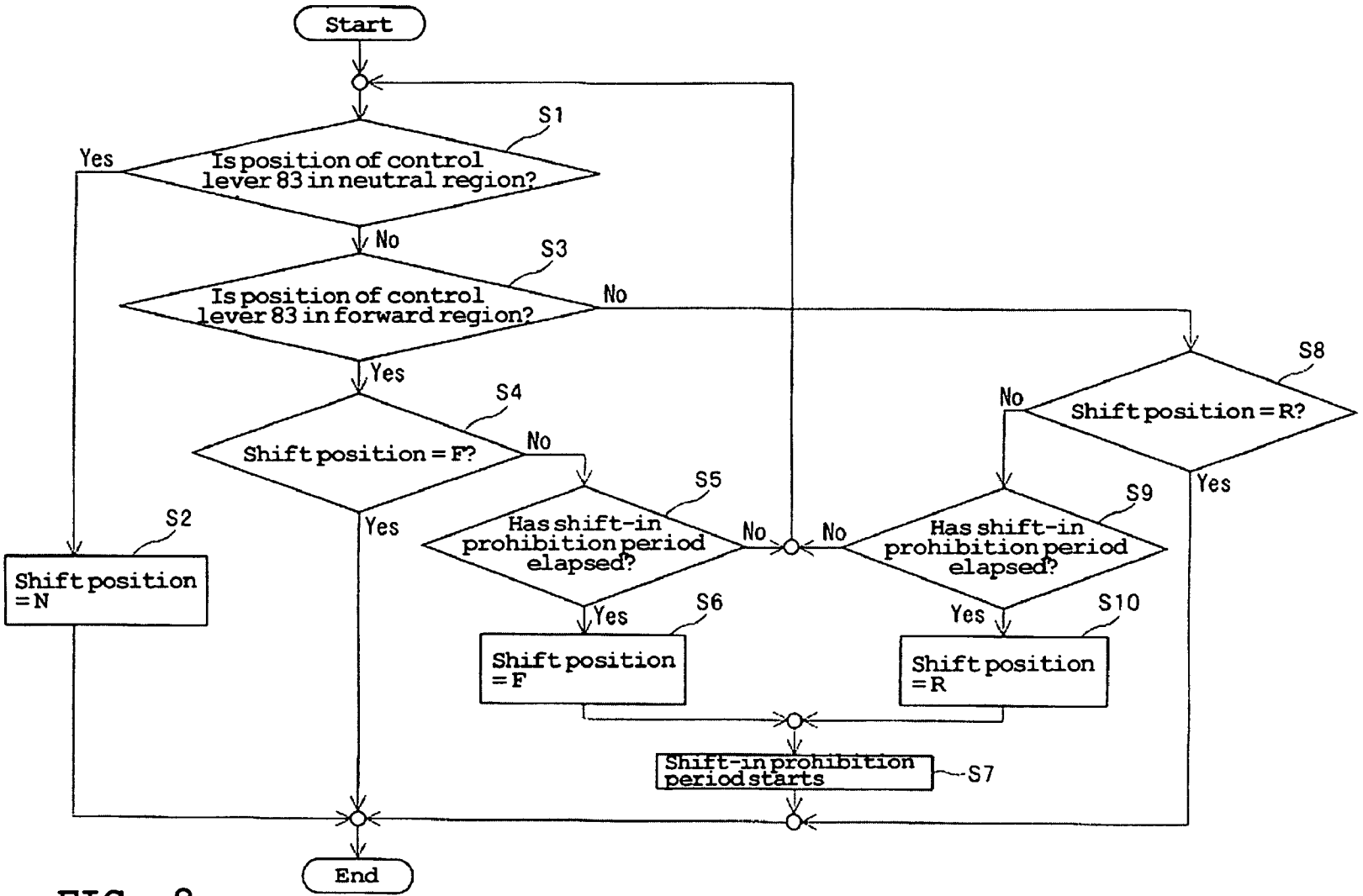
FIG. 8 is a flowchart showing gear shift control in accordance with the first preferred embodiment of the present invention.

More specifically, as shown in FIG. 8, first in step S1, the CPU 86*a* determines based on the output from the shift position sensor 85 whether or not the position of the control lever 83 is in a neutral region. In the case where it is determined in step S1 that the position of the control lever 83 is in the neutral region, the control proceeds to step S2. In step S2, the CPU 86*a* causes the actuator 70 to bring the shift position of the shift position switching mechanism 36 into the neutral position.

On the other hand, in the case where it is determined in step S1 that the position of the control lever 83 is not in the neutral region, the control proceeds to step S3. In step S3, the CPU 86*a* determines based on the output from the shift position sensor 85 whether or not the position of the control lever 83 is in a forward region. In the case where it is determined in step S3 that the position of the control lever 83 is in the forward region, the control proceeds to step S4.

In step S4, the CPU 86*a* determines based on the output from the shift position sensor 85 whether or not the shift position of the shift position switching mechanism 36 is in the forward position. In the case where it is determined in step S3 that the shift position of the shift position switching mechanism 36 is in the forward position, the control is terminated.

On the other hand, in the case where it is determined in step S4 that the shift position of the shift position switching mechanism 36 is not in the forward position, the control proceeds to step S5.

In step S5, the CPU 86*a* determines whether or not a shift-in prohibition period has elapsed. In the case where it is determined in step S5 that a shift-in prohibition period has not elapsed, the control returns to step S1. That is, the control returns from step S5 to step S1 during a shift-in prohibition period.

On the other hand, in the case where it is determined in step S5 that a shift-in prohibition period has elapsed, the control proceeds to step S6.

In step S6, the CPU 86*a* causes the actuator 70 to bring the shift position of the shift position switching mechanism 36 into the forward position.

Step S6 is followed by step S7. In step S7, the CPU 86*a* starts a shift-in prohibition period.

In the case where it is determined in step S3 discussed above that the position of the control lever 83 is not in the forward region, the control proceeds to step S8. That is, in the case where it is determined in step S3 that the position of the control lever 83 is in a reverse region, the control proceeds to step S8. In step S8, the CPU 86*a* determines based on the output from the shift position sensor 85 whether or not the shift position of the shift position switching mechanism 36 is in the reverse position. In the case where it is determined in step S8 that the shift position of the shift position switching mechanism 36 is in the reverse position, the control is terminated.

On the other hand, in the case where it is determined in step S8 that the shift position of the shift position switching mechanism 36 is not in the reverse position, the control proceeds to step S9. In step S9, the CPU 86*a* determines whether or not a shift-in prohibition period has elapsed. In the case where it is determined in step S9 that a shift-in prohibition period has not elapsed, the control returns to step S1. That is, in the case where it is determined to be during a shift-in prohibition period, the control returns to step S1.

On the other hand, in the case where it is determined in step S9 that a shift-in prohibition period has elapsed, the control proceeds to step S10. In step S10, the CPU 86*a* causes the actuator 70 to bring the shift position of the shift position switching mechanism 36 into the reverse position.

Step S10 is followed by step S7. In step S7, the CPU 86*a* starts a shift-in prohibition period.

Hereinafter, a specific description will be made based on an example shown in FIG. 7. In the example shown in FIG. 7, the control lever 83 is operated by the boat operator from the neutral position toward the high-speed forward position at time t1. This causes the shift position sensor 85 shown in FIG. 5 to output a signal that will cause a gear shift from the neutral position to the high-speed forward position to the control device 86 via the LAN 80.

Figure 7:
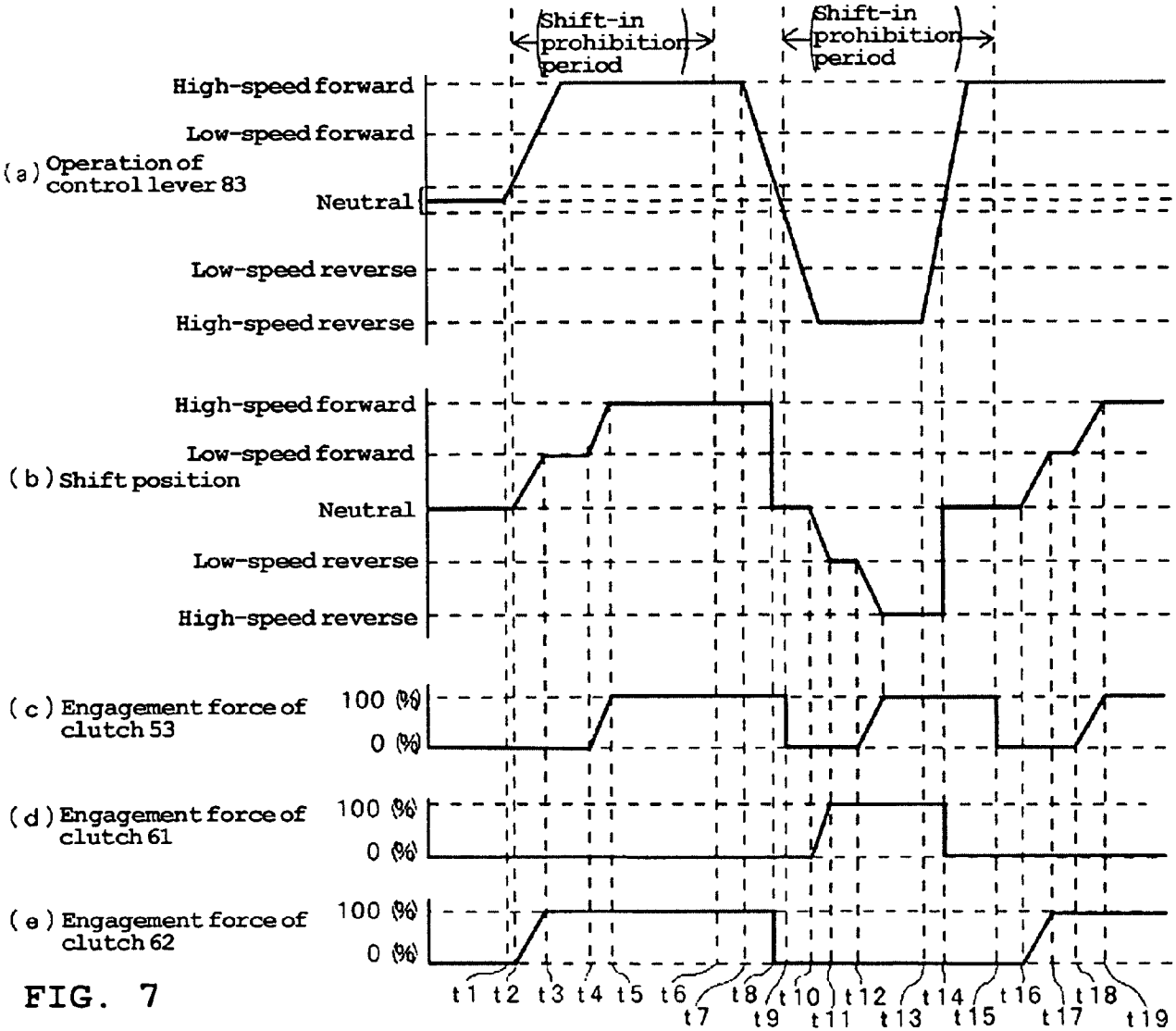
FIG. 7 is a graph showing changes over time in the operation of (a) a control lever, (b) the shift position, and the engagement forces of (c) the gear ratio switching hydraulic clutch, (d) the first and shift switching hydraulic clutch, and (e) the second shift switching hydraulic clutch, in which the relationships between changes over time in the operational position of a control lever, changes over time in the shift position, changes over time in the engagement force of the gear ratio switching hydraulic clutch, changes over time in the engagement force of the first shift switching hydraulic clutch, and changes over time in the engagement force of the second shift switching hydraulic clutch are shown.

Here, in the instance shown in FIG. 7, the gear ratio of the gear ratio switching mechanism 35 at time t1 is the low-speed gear ratio. Therefore, the second shift switching hydraulic clutch 62 starts being engaged at time t2, at which the position of the control lever 83 is changed from the neutral region to the forward region. As a result, the shift position is changed to the low-speed forward position at time t3.

In this preferred embodiment, the gear ratio of the gear ratio switching mechanism 35 is retained at the low-speed gear ratio during the period t3 to t4, even if the position of the control lever 83 is in the high-speed forward position. Then, the gear ratio switching hydraulic clutch 53 starts being engaged at time t4. As a result, the shift position is changed to the high-speed forward position at time t5. Here, the period t3 to t4 may be set appropriately according to the characteristics of the outboard motor 20, etc. For example, the period t3 to t4 may be set to about 0.5 seconds to about 30 seconds, preferably about 5 seconds to about 10 seconds.

The shift position is switched from the neutral position to the forward position at time t2. Therefore, a shift-in prohibition period starts at time t2, at which the shift position is changed from the neutral position to the forward position.

In the example shown in FIG. 7, the control lever 83 is operated from the high-speed forward position toward the high-speed reverse position at time t7. Here, time t7 is after the shift-in prohibition period t2 to t6 has elapsed. Therefore, the gear shift to the reverse position is not prohibited. Specifically, first, the second shift switching hydraulic clutch 62 is disengaged at time t8, at which the position of the control lever 83 reaches the neutral region. The shift position is thus switched from the high-speed forward position to the neutral position. Then, the gear ratio of the gear ratio switching mechanism 35 is changed to the low-speed gear ratio before the first shift switching hydraulic clutch 61 is engaged. Specifically, the gear ratio switching hydraulic clutch 53 is disengaged at time t9, which is before time t10, at which the first shift switching hydraulic clutch 61 starts being engaged. The gear ratio of the gear ratio switching mechanism 35 is thus changed to the low-speed gear ratio. After that, the first shift switching hydraulic clutch 61 starts being engaged at time t10. As a result, the shift position is changed to the low-speed reverse position at time t11.

After that, the gear ratio of the gear ratio switching mechanism 35 is maintained at the low-speed gear ratio during the period t11 to t12, even if the position of the control lever 83 is in the high-speed reverse position. The period t11 to t12 may be set to the same length as that of the period t3 to t4, for example.

Then, the gear ratio switching hydraulic clutch 53 starts being engaged at time t12. As a result, the shift position is switched from the low-speed reverse position to the high-speed reverse position.

In the example shown in FIG. 7, the control lever 83 is switched from the high-speed reverse position toward the high-speed forward position at time t13. However, time t13 is within the shift-in prohibition period t8 to t15. Therefore, the gear shift from the high-speed reverse position to the high-speed forward position is prohibited to minimize the load applied to the power source and the power transmission mechanism and minimize forces applied to the occupants of the boat.

Specifically, as shown in FIG. 7, the first shift switching hydraulic clutch 61 is disengaged at time t14, at which the position of the control lever 83 reaches the neutral region. The neutral shift position is thus established. After that, the neutral position is retained until the shift-in prohibition period t8 to t15 elapses.

In the example shown in FIG. 7, the position of the control lever 83 is still retained at the high-speed forward position at time t15. Here, the gear ratio of the gear ratio switching mechanism 35 is the high-speed gear ratio at time t15. Therefore, first, the gear ratio switching hydraulic clutch 53 is disengaged at time t15. The gear ratio of the gear ratio switching mechanism 35 is thus changed to the low-speed gear ratio. After that, the second shift switching hydraulic clutch 62 starts being engaged at time t16. As a result, the shift position is changed to the low-speed forward position at time t17. The low-speed forward position is maintained during the period t17 to t18. The gear ratio switching hydraulic clutch 53 starts being engaged at time t18. As a result, the gear ratio of the gear ratio switching mechanism 35 is changed to the high-speed gear ratio at time t19.

(2) Gradual increase of engagement forces of first shift switching hydraulic clutch and second shift switching hydraulic clutch.

In this preferred embodiment, when engagement is made from the neutral position to the high-speed forward position or the high-speed reverse position, the engagement force of the first shift switching hydraulic clutch 61 or the second shift switching hydraulic clutch 62 is gradually increased. The first shift switching hydraulic clutch 61 or the second shift switching hydraulic clutch 62 is thus engaged slowly.

For example, in the example shown in FIG. 7, the engagement force of the first shift switching hydraulic clutch 61 is gradually increased after time t10. The engagement force of the second shift switching hydraulic clutch 62 is gradually increased after time t16.

In this preferred embodiment, the engagement force of the first shift switching hydraulic clutch 61 or the second shift switching hydraulic clutch 62 may be gradually increased appropriately according to the engine speed, etc., besides at the time of shift-in after the above shift-in prohibition period has elapsed.

Specifically, in the example shown in FIG. 7, the shift position sensor 85 transmits a forward shift position signal to the control device 86 via the LAN 80 at time t16.

Figure 9:
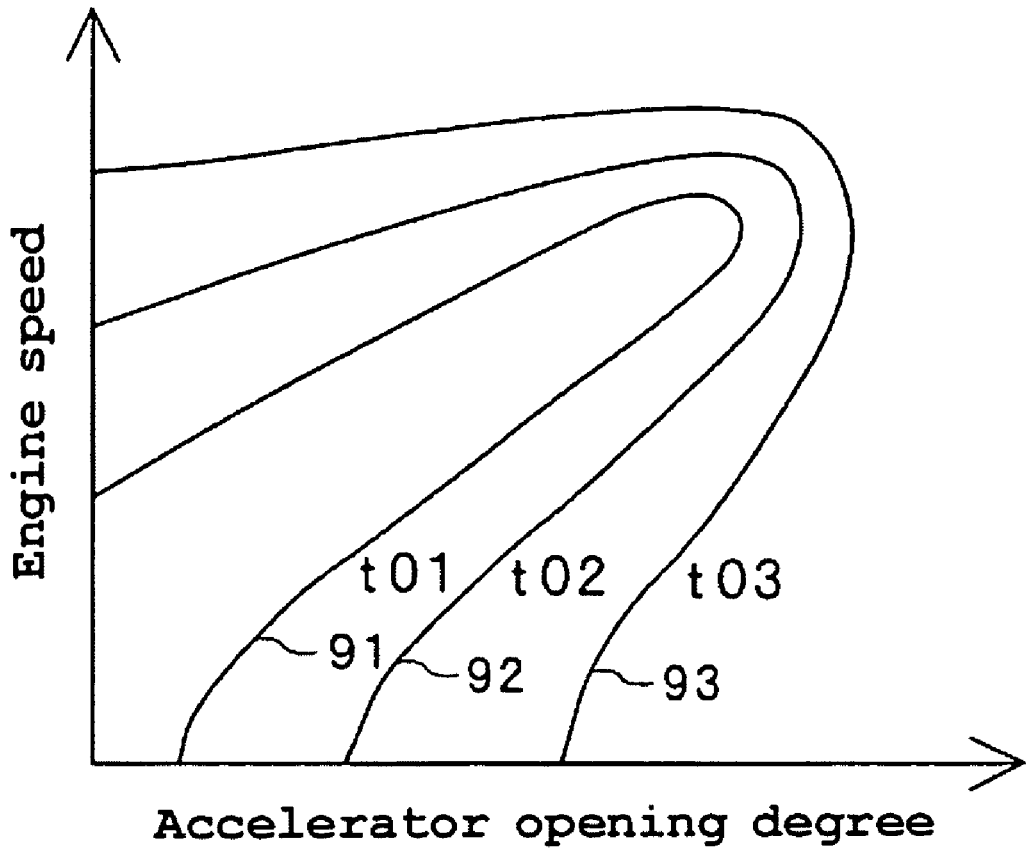
FIG. 9 is a map showing the relationship among the accelerator opening degree, the engine speed, and the clutch engagement time.

First, the CPU 86*a* preferably reads out a map shown in FIG. 9 stored in the memory 86*b*. The map shown in FIG. 9 shows the relationship among the accelerator opening degree, the engine speed, and the clutch engagement time. The CPU 86*a* determines the engagement time of the second shift switching hydraulic clutch 62 based on FIG. 9. That is, the engagement time of the second shift switching hydraulic clutch 62 is determined based on the engine speed and the accelerator opening degree.

Here, the term "engagement time" of a clutch refers to the time required from the start to the end of clutch engagement. More specifically, the term "engagement time" of a clutch refers to the time required since the clutch starts being engaged until the rotational speed of the output shaft becomes equal to that of the input shaft.

In this preferred embodiment, the language "clutch starts being engaged" refers to the time when the actuator arranged to engage and disengage the hydraulic clutch starts being driven.

Specifically, the engagement time of the second shift switching hydraulic clutch 62 is derived by substituting the accelerator opening degree and the engine speed immediately before the second shift switching hydraulic clutch 62 starts being engaged into the map shown in FIG. 9. For example, in the case where the point obtained by plotting on FIG. 9 the accelerator opening degree and the engine speed immediately before the second shift switching hydraulic clutch 62 starts being engaged falls between a line 91 and a line 92, the engagement time is derived as t01. In the case where the point obtained by plotting on FIG. 9 the accelerator opening degree and the engine speed immediately before the second shift switching hydraulic clutch 62 starts being engaged falls between the line 92 and a line 93, the engagement time is derived as t02. In the case where the point obtained by plotting on FIG. 9 the accelerator opening degree and the engine speed immediately before the second shift switching hydraulic clutch 62 starts being engaged falls outside the line 93, the engagement time is derived as t03. It should be noted that the relationship t01<t02<t03 should preferably be satisfied.

Figure 10:
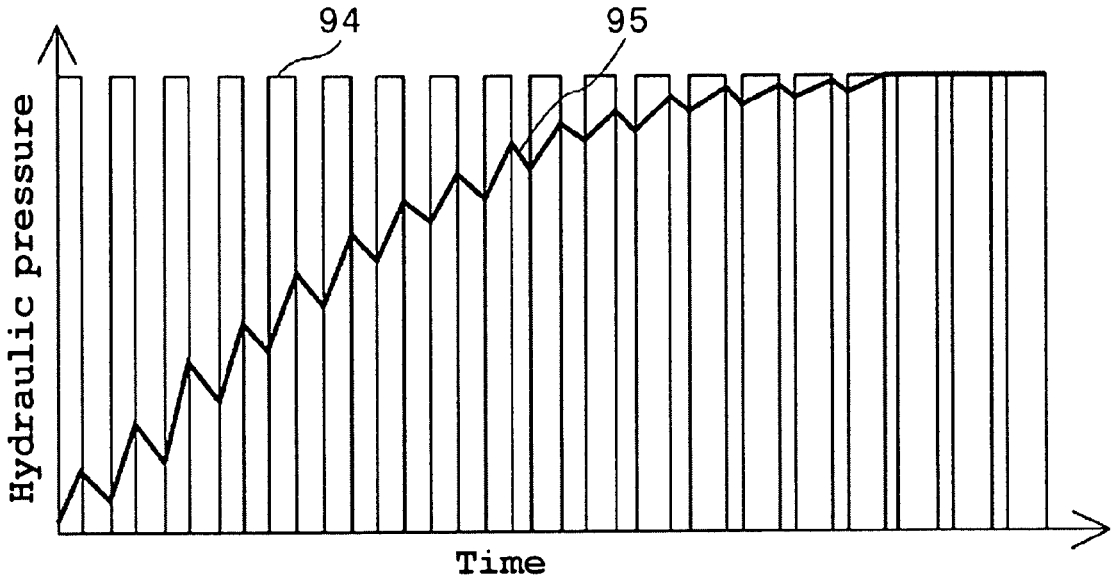
FIG. 10 is a graph showing the hydraulic pressure and a PWM signal output to a forward shift engaging electromagnetic valve in the case where the second hydraulic clutch is engaged at time t03.
Figure 11:
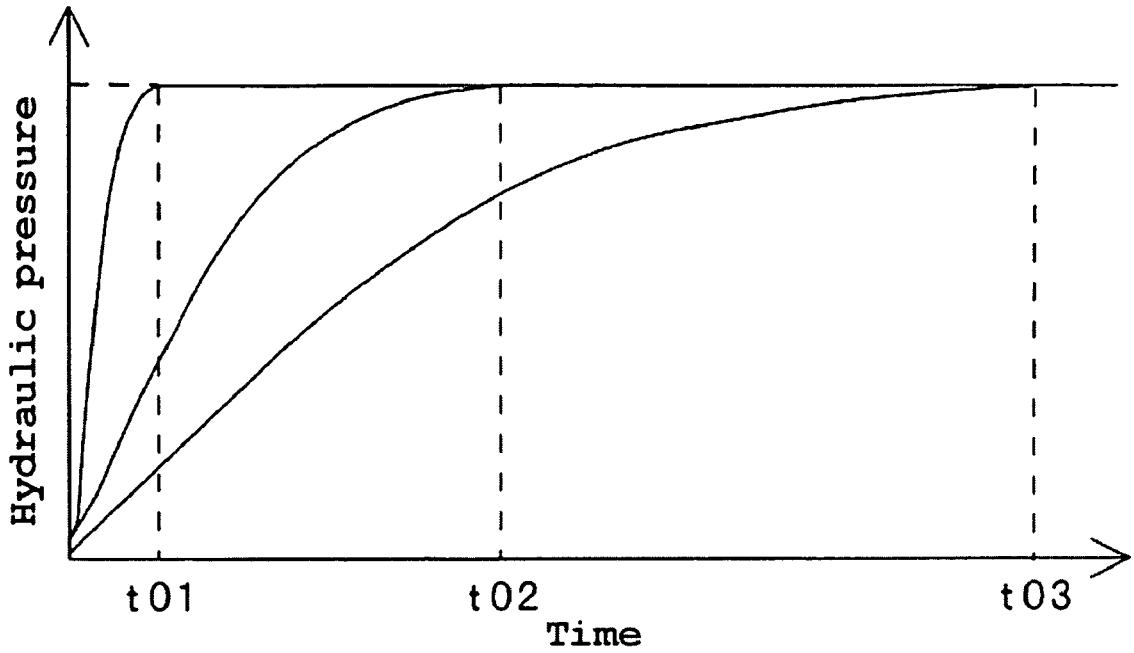
FIG. 11 is a graph showing changes overtime in the hydraulic pressure of the second hydraulic clutch that occur in the cases where the engagement time is t01, t02, and t03, respectively.

The CPU 86*a* controls the forward shift engaging electromagnetic valve 74 such that the second shift switching hydraulic clutch 62 is engaged over the derived engagement time. Specifically, in the case where the derived engagement time is t03, for example, the CPU 86*a* gradually increases the hydraulic pressure of the hydraulic piston 62*a* shown in FIG. 3 such that the second shift switching hydraulic clutch 62 reaches the completely engaged state after time t03, as shown in FIGS. 10 and 11. More specifically, the CPU 86*a* gradually increases the duty ratio of a duty signal output to the forward shift engaging electromagnetic valve 74 so as to reach about 100% after time t03, as shown in FIG. 10. The hydraulic pressure of the hydraulic piston 62*a* is thus increased gradually. As a result, the engagement force of the second shift switching hydraulic clutch 62 is gradually increased. A line 94 shown in FIG. 10 represents the duty signal output to the forward shift engaging electromagnetic valve 74. A thick line 95 represents the hydraulic pressure of the second shift switching hydraulic clutch 62.

In contrast, in the case where the derived engagement time is t02, for example, the hydraulic pressure of the hydraulic piston 62*a* shown in FIG. 3 is gradually increased such that the second shift switching hydraulic clutch 62 reaches the completely engaged state after time t02, as shown in FIG. 11. In the case where the derived engagement time is t01, for example, the hydraulic pressure of the hydraulic piston 62*a* shown in FIG. 3 is gradually increased such that the second shift switching hydraulic clutch 62 reaches the completely engaged state after time t01, as shown in FIG. 11.

In the example shown in FIGS. 10 and 11, the engagement force of the first shift switching hydraulic clutch 61 or the second shift switching hydraulic clutch 62 is gradually increased from the start to the completion of clutch engagement. More specifically, the clutch engagement force is gradually changed such that the change rate of the clutch engagement force is gradually reduced. However, the present invention is not limited to the above configuration.

Figure 12:
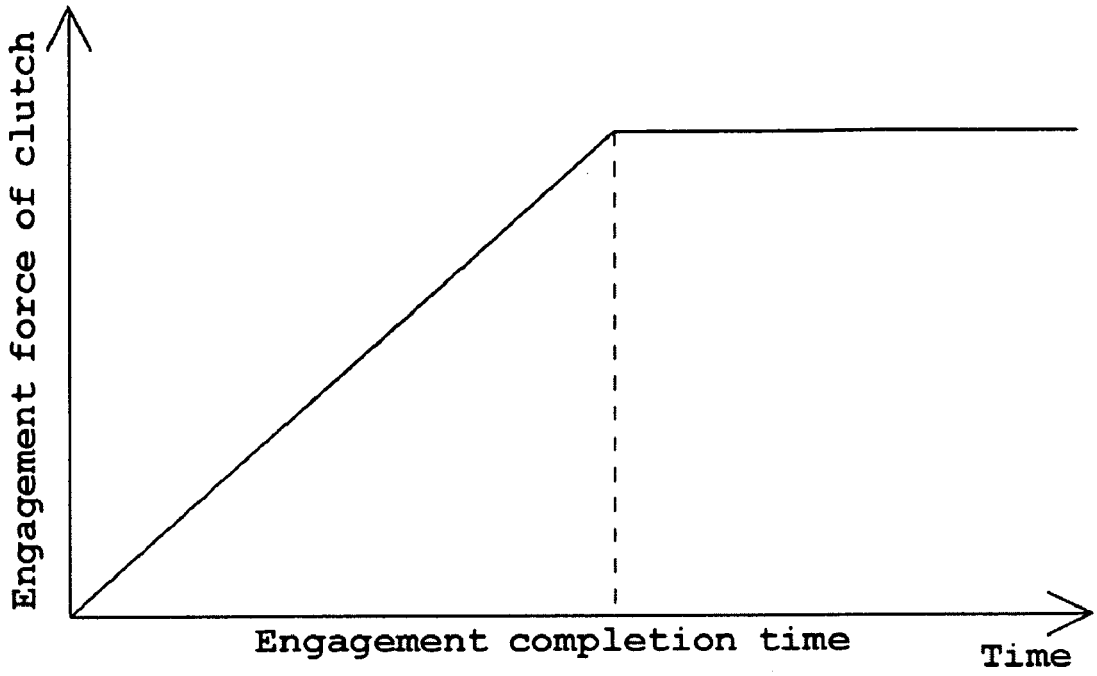
FIG. 12 is a graph showing changes over time in the engagement force of a shift engaging clutch that occur when a gear shift is made from the neutral position to the forward or reverse position in Example 1.

For example, as shown in FIG. 12, the engagement force of the first shift switching hydraulic clutch 61 or the second shift switching hydraulic clutch 62 may be monotonically increased from the start to the completion of clutch engagement.

Figure 13:
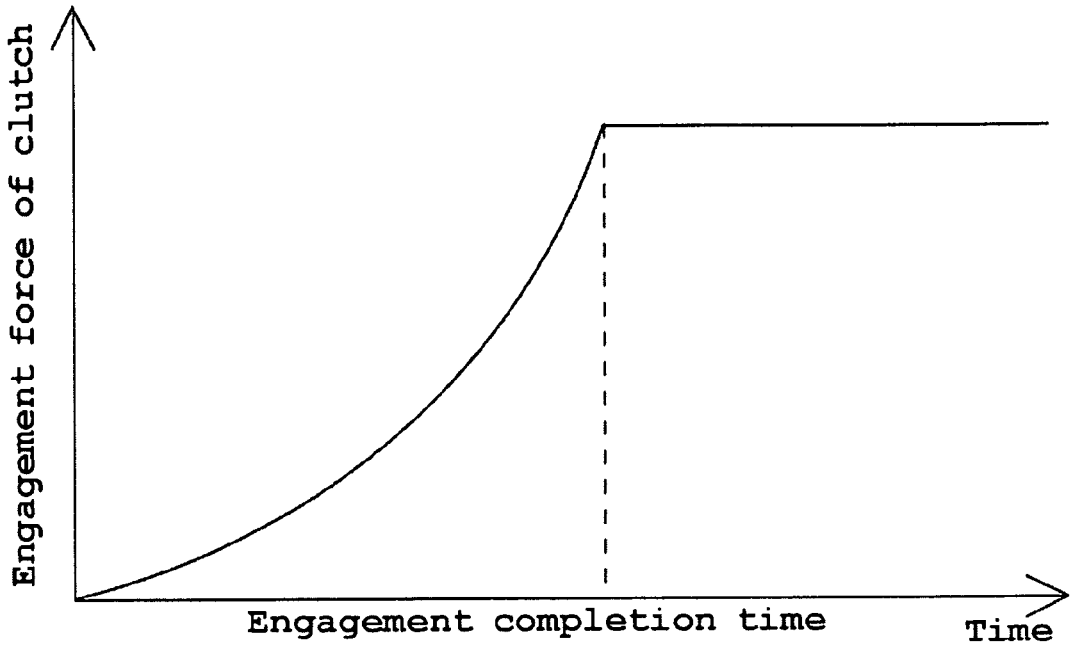
FIG. 13 is a graph showing changes over time in the engagement force of a shift engaging clutch that occur when a gear shift is made from the neutral position to the forward or reverse position in Example 2.

Alternatively, as shown in FIG. 13, the engagement force of the first shift switching hydraulic clutch 61 or the second shift switching hydraulic clutch 62 may be increased such that the change rate of the clutch engagement force is gradually increased from the start to the completion of clutch engagement.

Figure 14:
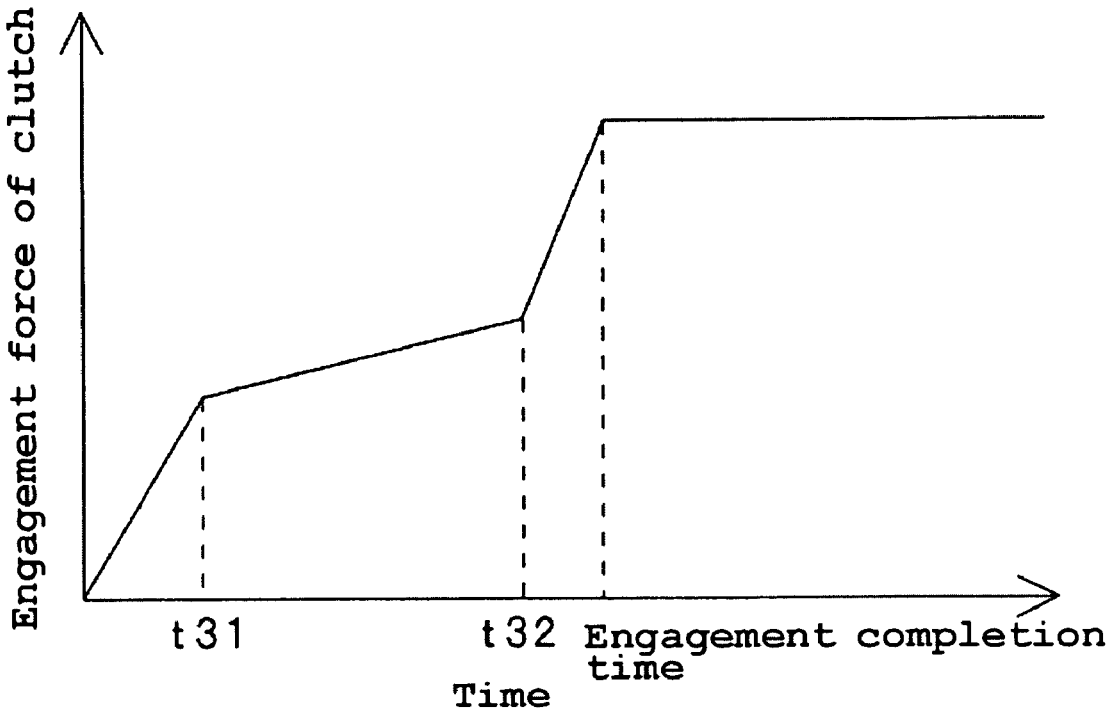
FIG. 14 is a graph showing changes over time in the engagement force of a shift engaging clutch that occur when a gear shift is made from the neutral position to the forward or reverse position in Example 3.

Still alternatively, as shown in FIG. 14, the engagement force of the first shift switching hydraulic clutch 61 or the second shift switching hydraulic clutch 62 may be gradually increased only during the period t31 to t32, which is a portion of the period from the start to the completion of engagement of the first shift switching hydraulic clutch 61 or the second shift switching hydraulic clutch 62. In other words, the engagement force of the first shift switching hydraulic clutch 61 or the second shift switching hydraulic clutch 62 may be rapidly increased during a part of the period from the start to the completion of clutch engagement.

Figure 15:
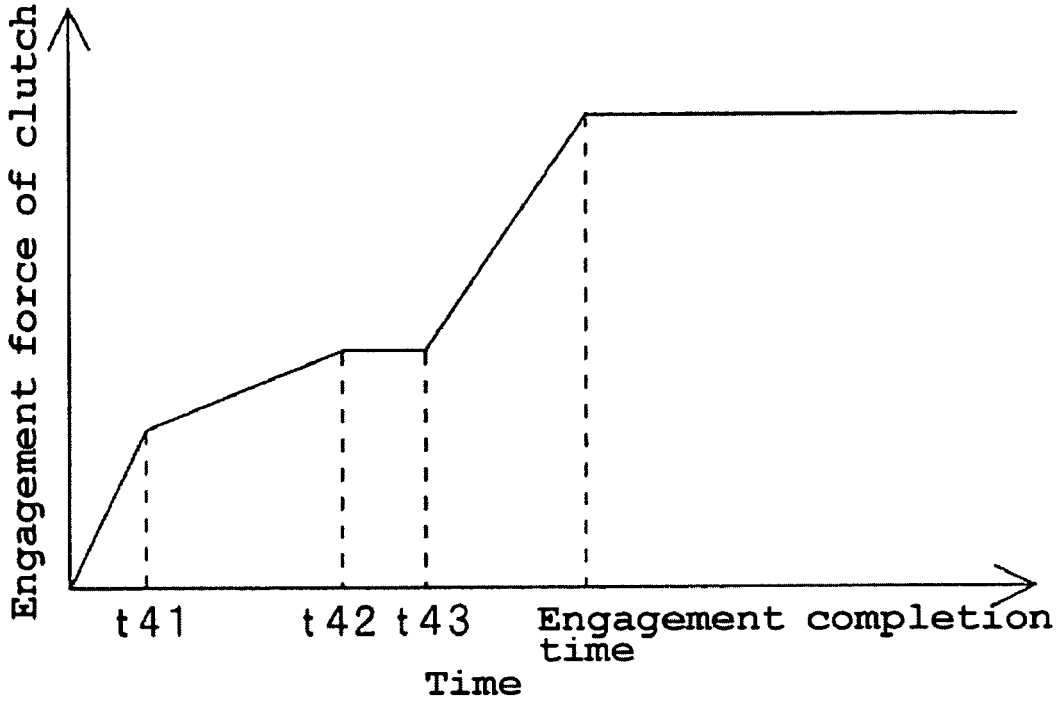
FIG. 15 is a graph showing changes over time in the engagement force of a shift engaging clutch that occur when a gear shift is made from the neutral position to the forward or reverse position in Example 4.

Further alternatively, as shown in FIG. 15, the engagement force of the first shift switching hydraulic clutch 61 or the second shift switching hydraulic clutch 62 may be retained to be constant during the period t42 to t43, which is a portion of the period from the start to the completion of clutch engagement. Specifically, the engagement force of the first shift switching hydraulic clutch 61 or the second shift switching hydraulic clutch 62 may be gradually changed during the period t41 to t42, which is a part of the period from the start to the completion of clutch engagement. After that, the engagement force may be retained to be constant during the period t42 to t43. Then, the engagement force may be rapidly increased after t43.

As described above, the engagement forces of the shift switching clutches 61 and 62 may be gradually increased appropriately based on the characteristics of the clutches 61 and 62, the characteristics of the outboard motor 20 and the boat 1, etc.

(3) Reduction in engagement forces of first shift switching hydraulic clutch and second shift switching hydraulic clutch based on torque generated between engine and propeller.

When the clutch engagement force is to be gradually increased at the time of switching the shift position from the neutral position to the high-speed forward or high-speed reverse position, the CPU 86*a* reduces the clutch engagement force according to the torque generated between the engine 30 and the propeller 41 detected by the torque sensor 89.

Hereinafter, a specific description will be made using an exemplary case where the shift position is switched from the neutral position to the high-speed forward position. The memory 86*b* stores a map shown in FIG. 16. The map shown in FIG. 16 defines the relationship among the torque generated between the engine 30 and the propeller 41, the rotational speed of the engine 30, and the engagement force of the second shift switching hydraulic clutch 62. Hereinafter, the map shown in FIG. 16 will be referred to as a "torque-engagement force map" for convenience of description.

When the second shift switching hydraulic clutch 62 is engaged, the torque sensor 89 detects the amount of torque generated between the engine 30 and the propeller 41 every predetermined period. The torque sensor 89 outputs the detected amount of torque to the control device 86.

The CPU 86*a* of the control device 86 reads out the torque-engagement force map from the memory 86*b*. The CPU 86*a* calculates the engagement force of the second shift switching hydraulic clutch 62 based on the torque from the torque sensor 89 and the engine speed from the engine speed sensor 88 using the torque-engagement force map. The CPU 86*a* compares the calculated engagement force of the second shift switching hydraulic clutch 62 with the actual current engagement force of the second shift switching hydraulic clutch 62. In the case where the calculated engagement force of the second shift switching hydraulic clutch 62 is smaller than the actual current engagement force of the second shift switching hydraulic clutch 62, the CPU 86*a* causes the actuator 70 to reduce the engagement force of the second shift switching hydraulic clutch 62. Specifically, the engagement force of the second shift switching hydraulic clutch 62 is reduced to the calculated engagement force of the second shift switching hydraulic clutch 62.

Figure 16:
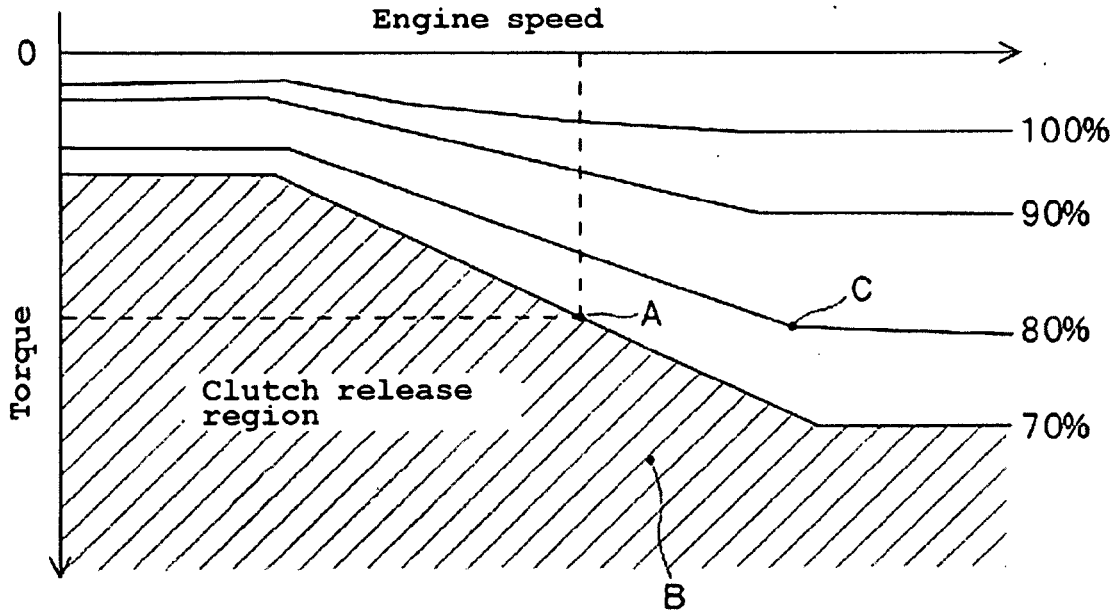
FIG. 16 is a map showing the relationship among the engine speed, the torque, and the clutch engagement force.
Figure 17:
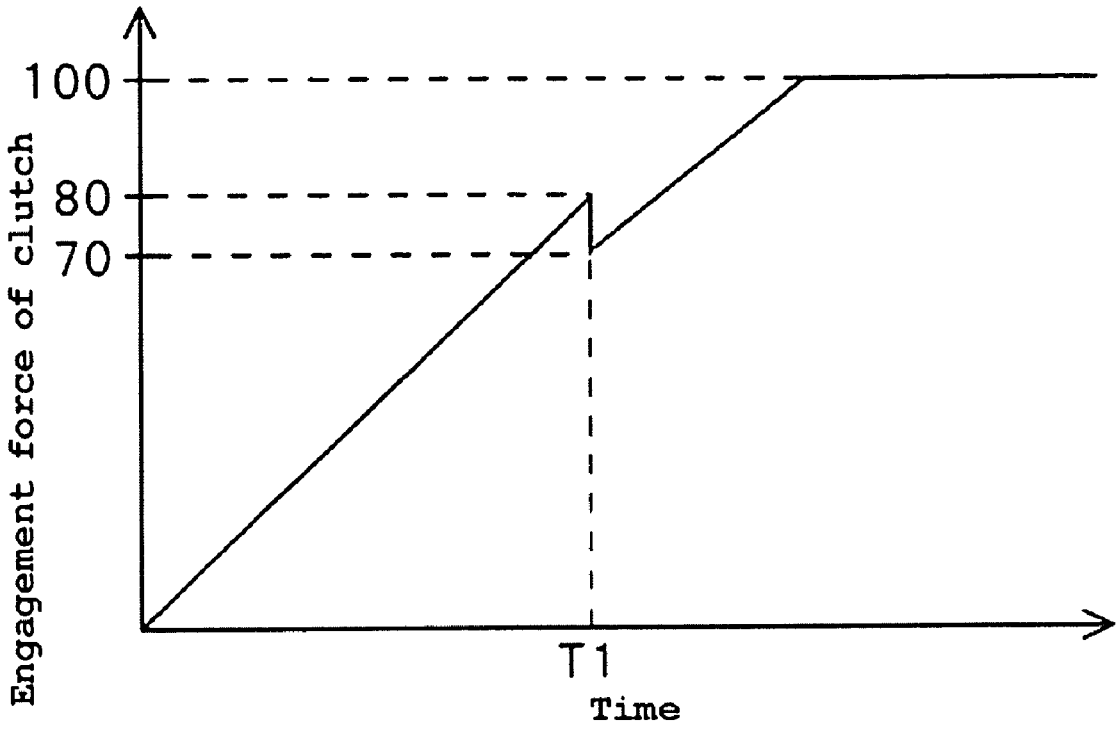
FIG. 17 is a graph showing changes in the clutch engagement force that occur in the case where the clutch engagement force obtained from FIG. 16 is smaller than the actual clutch engagement force at time T1.

It is assumed, for example, that in the case where the engagement force of the second shift switching hydraulic clutch 62 at time T1 is 80%, as shown in FIG. 17, a point A is plotted on the torque-engagement force map shown in FIG. 16. In this case, the calculated engagement force of the second shift switching hydraulic clutch 62 is 70%. The calculated engagement force of the second shift switching hydraulic clutch 62 is thus smaller than the actual engagement force of the second shift switching hydraulic clutch 62. Here, the torque detected by the torque sensor 89 tends to be smaller as the engagement force of the second shift switching hydraulic clutch 62 is larger. Hence, the torque being generated between the engine 30 and the propeller 41 is larger than the torque that should be generated between the engine 30 and the propeller 41 as prescribed in FIG. 16.

In this case, as shown in FIG. 17, the CPU 86*a* causes the actuator 70 to reduce the engagement force of the second shift switching hydraulic clutch 62 from 80% to 70% at time T1. After that, the CPU 86*a* causes the actuator 70 to gradually increase the engagement force of the second shift switching hydraulic clutch 62 again.

Figure 18:
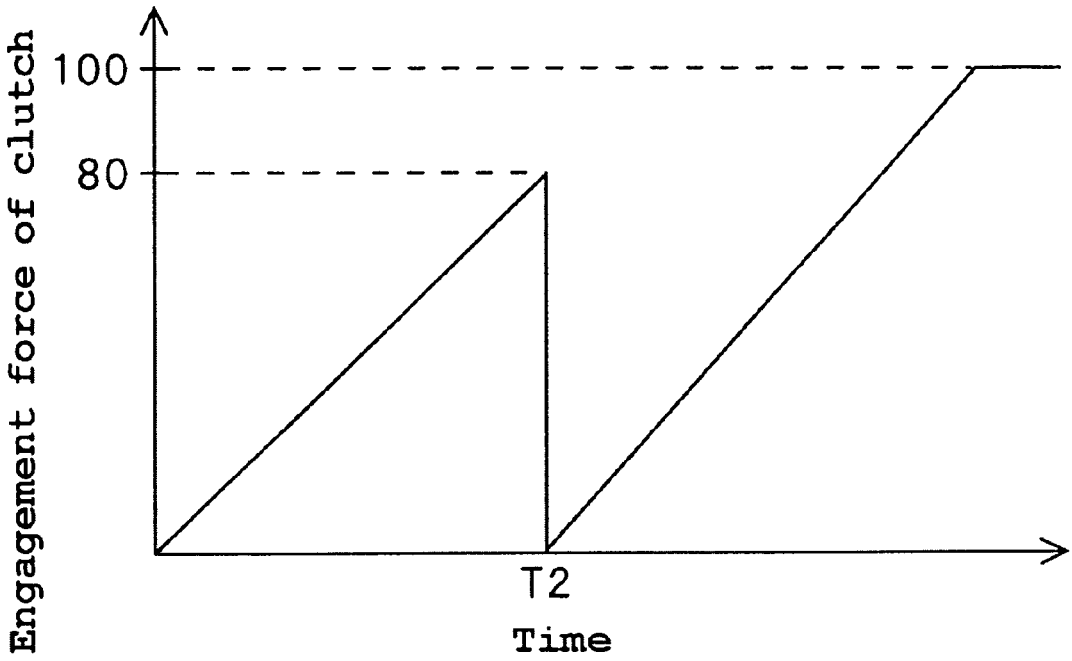
FIG. 18 is a graph showing changes in the clutch engagement force that occur in the case where the clutch engagement force obtained from FIG. 16 is smaller than the actual clutch engagement force at time T2.

It is assumed, for example, that in the case where the engagement force of the second shift switching hydraulic clutch 62 at time T2 is 80%, as shown in FIG. 18, a point B is plotted on the torque-engagement force map shown in FIG. 16. As shown in FIG. 16, the point B is positioned in the clutch release region. Thus, in this case, as shown in FIG. 18, the CPU 86*a* causes the actuator 70 to reduce the engagement force of the second shift switching hydraulic clutch 62 from 80% to 0% at time T2. In other words, the CPU 86*a* causes the actuator 70 to disengage the second shift switching hydraulic clutch 62. After that, the CPU 86*a* causes the actuator 70 to gradually increase the engagement force of the second shift switching hydraulic clutch 62 again.

Figure 19:
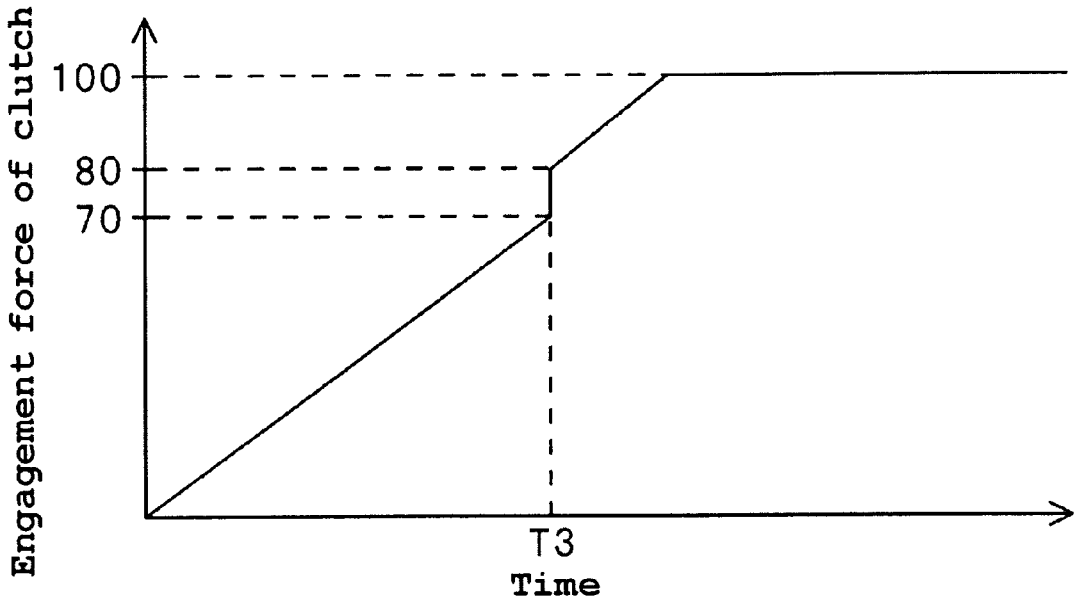
FIG. 19 is a graph showing changes in the clutch engagement force that occur in the case where the clutch engagement force obtained from FIG. 16 is larger than the actual clutch engagement force at time T3.

Moreover, it is assumed, for example, that in the case where the engagement force of the second shift switching hydraulic clutch 62 at time T3 is 70%, as shown in FIG. 19, a point C is plotted on the torque-engagement force map shown in FIG. 16. In this case, the calculated engagement force of the second shift switching hydraulic clutch 62 is 80%. The calculated engagement force of the second shift switching hydraulic clutch 62 is thus larger than the actual engagement force of the second shift switching hydraulic clutch 62. Hence, the torque being generated between the engine 30 and the propeller 41 is smaller than the torque that should be generated between the engine 30 and the propeller 41 as prescribed in FIG. 16.

In this case, as shown in FIG. 19, the CPU 86*a* causes the actuator 70 to increase the engagement force of the second shift switching hydraulic clutch 62 from 70% to 80% at time T3. As described above, in the case where the torque being actually generated is smaller than the prescribed torque, the clutch engagement speed may be increased.

The engine speed and the propeller speed are correlated with each other. Therefore, the engagement time of the first shift switching hydraulic clutch 61 may be determined according to the propeller speed detected by the propeller speed sensor 90 in place of the engine speed.

As has been described above, in this preferred embodiment, when a gear shift is made from the neutral position to the high-speed forward or high-speed reverse position, switching is performed to the low-speed gear ratio before shift-in to the forward or reverse position. That is, the low-speed gear ratio has been established at the time of shift-in from the neutral position to the forward position. Therefore, it is possible to reduce the load applied to the engine 30, etc., at the time of a gear shift from the neutral position to the forward or reverse position. Thus, it is possible to further improve the durability of the engine 30, the power transmission mechanism 32, and so forth.

Herein, the phrase "switching to the first shift position" means the completion of switching to the first shift position. Specifically, the phrase "establish the low-speed gear ratio before switching to the first shift position" exactly means to establish the low-speed gear ratio before switching to the first shift position has been completed. For example, the phrase "establish the low-speed gear ratio before switching to the first shift position" includes the case where the low-speed gear ratio is established after switching to the first shift position has been started but before the switching to the first shift position has not been completed and the switching to the first shift position is completed after the establishment of the low-speed gear ratio. Also herein, the phrase "switch to the first shift position, and then establish the high-speed gear ratio" means to establish the high-speed gear ratio after the completion of switching to the first shift position.

Moreover, in this preferred embodiment, as illustrated in FIG. 7, the gear ratio of the gear ratio switching mechanism 35 is switched from the low speed to the high speed after the completion of shift-in from the neutral position to the forward position. In other words, a gear shift is made once from the neutral position to the low-speed forward or low-speed reverse position, and then a gear shift is made from the low-speed forward or low-speed reverse position to the high-speed forward or high-speed reverse position. Thus, it is possible to further reduce the load applied to the engine 30, etc., at the time of a gear shift from the neutral position to the forward or reverse position.

Further, in this preferred embodiment, the gear ratio of the gear ratio switching mechanism 35 is retained at the low speed over a predetermined period after the completion of shift-in from the neutral position to the forward position. Thus, it is possible to further reduce the load applied to the engine 30, etc., at the time of a gear shift from the neutral position to the forward or reverse position.

Figure 20:
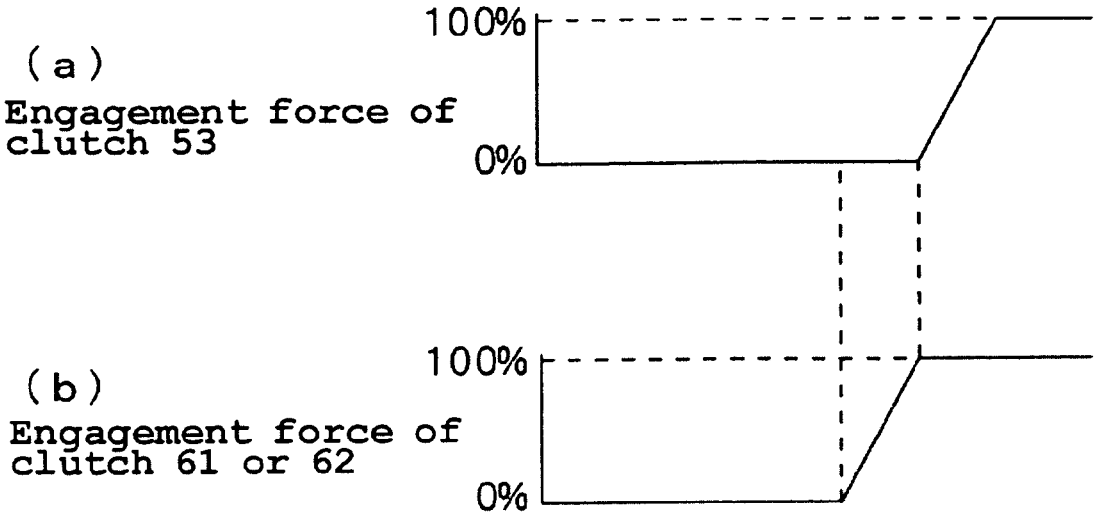
FIG. 20 is a time chart showing the engagement timings of (a) the gear ratio switching hydraulic clutch and (b) the shift switching hydraulic clutch in Example 5.

However, the present invention is not limited to the above. For example, as shown in FIG. 20, the gear ratio switching hydraulic clutch 53 may start being engaged at the same time as the completion of engagement of the first or second shift switching hydraulic clutch 61 or 62. In this way, it is possible to shorten the time required for a gear shift from the neutral position to the high-speed forward or reverse position.

Figure 21:
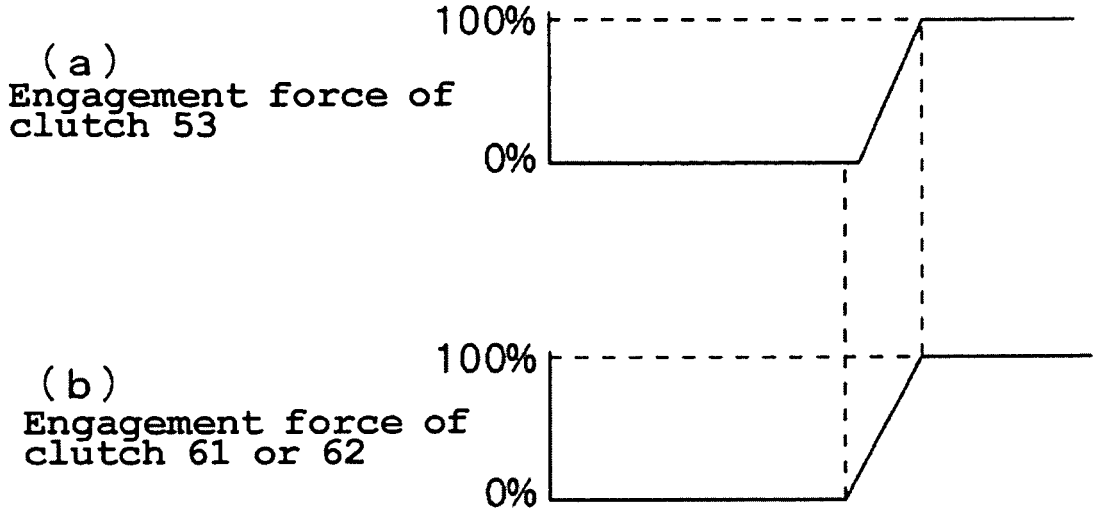
FIG. 21 is a time chart showing the engagement timings of (a) the gear ratio switching hydraulic clutch and (b) the shift switching hydraulic clutch in Example 6.

Moreover, as shown in FIG. 21, for example, the gear ratio switching hydraulic clutch 53 may start being engaged during the period from the start to the completion of engagement of the first or second shift switching hydraulic clutch 61 or 62. In this way, it is possible to further shorten the time required for a gear shift from the neutral position to the high-speed forward or reverse position.

In this case, the time of the completion of engagement of the gear ratio switching hydraulic clutch 53 may be earlier or later than the time of the completion of engagement of the first or second shift switching hydraulic clutch 61 and 62. As shown in FIG. 21, the time of the completion of engagement of the gear ratio switching hydraulic clutch 53 may be substantially the same as the time of the completion of engagement of the first or second shift switching hydraulic clutch 61 and 62.

In this preferred embodiment, when engagement is made from the neutral position to the high-speed forward position or the high-speed reverse position, the engagement force of the first shift switching hydraulic clutch 61 or the second shift switching hydraulic clutch 62 is gradually increased. The first shift switching hydraulic clutch 61 or the second shift switching hydraulic clutch 62 is thus engaged slowly. Thus, it is possible to reduce the load applied to the engine 30, the power transmission mechanism 32, the propulsion section 33, and so forth.

Moreover, in this preferred embodiment, when engagement is made from the neutral position to the high-speed forward or high-speed reverse position, the CPU 86*a* reduces the clutch engagement force according to the torque generated between the engine 30 and the propeller 41 detected by the torque sensor 89. Specifically, the clutch engagement force is reduced when the torque being actually generated between the engine 30 and the propeller 41 becomes larger than the prescribed torque.

When the torque being actually generated between the engine 30 and the propeller 41 is larger than the prescribed torque, a relatively large load is being applied to the engine 30, etc. By reducing the clutch engagement force at this time, as in this embodiment, the efficiency of transmission of the torque generated by the propeller 41 to the engine 30 is reduced. Thus, it is possible to effectively reduce the load applied to the engine 30, etc.

When the torque actually being generated between the engine 30 and the propeller 41 is smaller than the prescribed torque, the clutch engagement force can be increased. Therefore, it is possible to shorten the time needed for clutch engagement. As a result, it is possible to shorten the time required for a gear shift.

In order to improve the following response to operations of the control lever 83 for gear shifts, it is considered to be preferable not to provide a shift-in prohibition period. However, there exists a certain time lag between an operation of the control lever 83 and the completion of a gear shift. Therefore, with no shift-in prohibition period provided, if the control lever 83 is operated consecutively, for example, it may rather be difficult to make gear shifts following actual operations of the control lever 83. For example, in the case where a plurality of relatively quick operations are made to make gear shifts between the forward and reverse positions, it takes a relatively long time to complete all gear shifts corresponding to the plurality of operations of the control lever 83. Thus, it takes a relatively long time to establish a shift position corresponding to the final position of the control lever 83.

In contrast, a shift-in prohibition period is provided in this preferred embodiment. Therefore, even if the control lever 83 is operated consecutively, for example, any gear shift to the forward or reverse position is not made during the shift-in prohibition period. A gear shift is then made after the shift-in prohibition period has elapsed. Specifically, a gear shift is made to a shift position corresponding to the position of the control lever 83 after the lapse of the shift-in prohibition period. Therefore, in the case where the control lever 83 is operated consecutively, it is possible to further shorten the time needed to establish a shift position corresponding to the final position of the control lever 83. It is thus possible to improve the operability of the boat 1.

Specifically, in this preferred embodiment, in the case where the control lever 83 is operated to a position corresponding to the forward or reverse position during a shift-in prohibition period, the shift position is subsequently retained at the neutral position over the shift-in prohibition period. Therefore, in the case where a plurality of consecutive operations are made for gear shifts between the forward and reverse positions, it is possible to reduce the load applied to the shift position switching mechanism 36, etc.

During a shift-in prohibition period, the following control (1) or (2), for example, may be performed:

(1) The throttle opening degree, which is the degree of opening of a throttle valve provided in the throttle body 87, is not caused to follow the accelerator opening degree, which is the operation amount of the control lever 83. For example, the throttle opening degree is retained to be generally constant irrespective of the accelerator opening degree. Alternatively, the throttle opening degree is retained to be generally constant even if the accelerator opening degree is increased, for example.

(2) The output of the engine 30 is retained to be generally constant irrespective of the accelerator opening degree, which is the operation amount of the control lever 83. For example, the output of the engine 30 is retained to be generally constant even if the accelerator opening degree is increased.

Moreover, in the case where the control lever 83 is operated to a position corresponding to the forward or reverse position during a shift-in prohibition period, the current shift position may be retained, for example.

The specific control of the boat 1 described in this preferred embodiment may not always be performed under all operating conditions. Such control may be performed as needed depending on the conditions of the boat 1. Specifically, such control may be performed at least in the state where the boat 1 is traveling fast and a large load is being applied to the engine 30.

EXAMPLES

When switching is to be performed from the neutral position to the forward or reverse position and the high-speed gear ratio, a gear shift to the forward or reverse position and switching of the gear ratio may be made at constant timings irrespective of the operating speed of the control lever 83. Alternatively, when switching is to be performed from the neutral position to the forward or reverse position and the high-speed gear ratio, a gear shift to the forward or reverse position and switching of the gear ratio may be made at different timings in accordance with the operating speed of the control lever 83.

For example, in the case where the control lever 83 is operated by the boat operator slowly from a position corresponding to the neutral position to a position corresponding to the forward or reverse position, switching to the forward or reverse position may first be completed, and immediately thereafter, the high-speed gear ratio may be established.

Moreover, in the case where the control lever 83 is operated by the boat operator quickly, at a predetermined operating speed or more, from a position corresponding to the neutral position to a position corresponding to the forward or reverse position, switching to the forward or reverse position may first be completed, then the low-speed gear ratio may be retained for a predetermined period, and then the high-speed gear ratio may be established. Here, the "predetermined operating speed" may be set to a value of about 50%/sec or more, for example. The upper limit of the "predetermined operating speed" is not specifically limited. In general, the upper limit of the "predetermined operating speed" is the maximum speed at which a human can make an operation. In general, the maximum speed at which a human can make an operation is about 1,000%/sec. to about 10,000%/sec. Here, "100%" corresponds to the maximum forward or reverse position. "0%" corresponds to the center position. The "predetermined period" refers to about 0.2 seconds to about 30 seconds, for example.

In the above preferred embodiment, the memory 86*b* in the control device 86 mounted on the outboard motor 20 preferably stores a map arranged to control the gear ratio switching mechanism 35 and a map for controlling the shift position switching mechanism 36. In addition, the CPU 86*a* in the control device 86 mounted on the outboard motor 20 outputs control signals for controlling the electromagnetic valves 72, 73, 74.

However, the present invention is not limited to this configuration. For example, the controller 82 mounted on the hull 10 may be provided with a memory as a storage section and a CPU as a computation section, in addition to or in place of the memory 86*b* and the CPU 86*a*. In this case, the memory provided in the controller 82 may store a map arranged to control the gear ratio switching mechanism 35 and a map arranged to control the shift position switching mechanism 36. In addition, the CPU provided in the controller 82 may output control signals for controlling the electromagnetic valves 72, 73, 74.

In the above preferred embodiment, the control device 86 controls both the engine 30 and the electromagnetic valves 72, 73, 74. However, the present invention is not limited thereto. For example, an ECU arranged to control the engine and an ECU arranged to control the electromagnetic valves may be separately provided.

In the above preferred embodiment, the controller 82 is a so-called "electronic controller". Here, the term "electronic controller" refers to a controller that converts the operation amount of the control lever 83 into an electric signal and outputs the electric signal to the LAN 80.

In the present invention, however, the controller 82 may not necessarily be an electronic controller. For example, the controller 82 may be a so-called mechanical controller, for example. Here, the term "mechanical controller" refers to a controller that includes a control lever and a wire connected to the control lever and that transmits the amount and direction of operation of the control lever to the outboard motor as physical amounts indicated by the amount and direction of operation of the wire.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A boat propulsion system comprising:

a power source arranged to generate a rotational force;

a boat propulsion section having a propeller arranged to be driven by the rotational force to generate a propulsive force;

a shift position switching mechanism disposed between the power source and the propulsion section and arranged to switch among a first shift position, a second shift position in which the rotational force of the power source is transmitted to the propulsion section in a direction opposite to the direction in the first shift position, and a neutral position in which the rotational force of the power source is not transmitted to the propulsion section;

a gear ratio switching mechanism disposed between the power source and the propulsion section and arranged to switch a gear ratio between the power source and the propulsion section between a low-speed gear ratio and a high-speed gear ratio;

a control lever arranged to allow a boat operator to switch the shift position of the shift position switching mechanism and to switch the gear ratio of the gear ratio switching mechanism;

an actuator arranged to drive the shift position switching mechanism and the gear ratio switching mechanism; and a control section programmed to control the actuator to switch the shift position of the shift position switching mechanism and the gear ratio of the gear ratio switching mechanism based on a detected position of the control lever; wherein when switching is to be performed from the neutral position to the first shift position and the high-speed gear ratio, the control section causes the actuator to:

when the current gear ratio of the gear ratio switching mechanism is the low-speed gear ratio, maintain the low-speed gear ratio, then switch to the first shift position, and then establish the high-speed gear ratio; and when the current gear ratio of the gear ratio switching mechanism is the high-speed gear ratio, prohibit switching to the first shift position, establish the low-speed gear ratio even though the detected position of the control lever is the first shift position and the high-speed gear ratio, then switch to the first shift position, and then establish the high-speed gear ratio.

2. The boat propulsion system according to claim 1, wherein when switching is to be performed from the neutral position to the first shift position and the high-speed gear ratio, the control section causes the actuator to establish the high-speed gear ratio after completion of the switching to the first shift position.

3. The boat propulsion system according to claim 1, wherein the shift position switching mechanism includes a clutch arranged to change an engagement state between the power source and the propulsion section, the shift position becoming the neutral position when the clutch is disengaged; and the control section is programmed to cause the actuator to gradually increase an engagement force of the clutch until the clutch is engaged when switching is to be performed from the neutral position to the first shift position and the high-speed gear ratio.

4. The boat propulsion system according to claim 1, wherein the control section is programmed to prohibit switching to the second shift position until a predetermined time elapses after the switching to the first shift position.

5. The boat propulsion system according to claim 1 wherein:

if the control lever is operated at a predetermined speed or more when switching is to be performed from the neutral position to the first shift position and the high-speed gear ratio, the control section causes the actuator to switch to the first shift position, retain the gear ratio at the low-speed gear ratio for a predetermined time after completion of the switching to the first shift position, and then establish the high-speed gear ratio.

6. A control device for a boat propulsion system, the control device comprising:

a power source arranged to generate a rotational force;

a boat propulsion section having a propeller arranged to be driven by the rotational force and to generate a propulsive force;

a shift position switching mechanism disposed between the power source and the propulsion section and arranged to switch among a first shift position, a second shift position in which the rotational force of the power source is transmitted to the propulsion section in a direction opposite to that in the first shift position, and a neutral position in which the rotational force of the power source is not transmitted to the propulsion section;

a gear ratio switching mechanism disposed between the power source and the propulsion section and arranged to switch a gear ratio between the power source and the propulsion section between a low-speed gear ratio and a high-speed gear ratio; and a control lever arranged to allow a boat operator to switch the shift position of the shift position switching mechanism and the gear ratio of the gear ratio switching mechanism;

an actuator arranged to drive the shift position switching mechanism and the gear ratio switching mechanism; and a control section programmed to control the actuator to switch the shift position of the shift position switching mechanism and to switch the gear ratio of the gear ratio switching mechanism based on a detected position of the control lever; wherein when switching is to be performed from the neutral position to the first shift position and the high-speed gear ratio, the actuator is arranged to:

when the current gear ratio of the gear ratio switching mechanism is the low-speed gear ratio, maintain the low-speed gear ratio, then switch to the first shift position, and then establish the high-speed gear ratio; and when the current gear ratio of the gear ratio switching mechanism is the high-speed gear ratio, to prohibit switching to the first shift position, establish the low-speed gear ratio even though the detected position of the control lever is the first shift position and the high-speed gear ratio, then switch to the first shift position, and then establish the high-speed gear ratio.

7. A control method for a boat propulsion system, the boat propulsion system including:

a power source arranged to generate a rotational force;

a boat propulsion section having a propeller arranged to be driven by the rotational force and to generate a propulsive force;

a shift position switching mechanism disposed between the power source and the propulsion section and arranged to switch among a first shift position, a second shift position in which the rotational force of the power source is transmitted to the propulsion section in a direction opposite to that in the first shift position, and a neutral position in which the rotational force of the power source is not transmitted to the propulsion section;

a gear ratio switching mechanism disposed between the power source and the propulsion section and arranged to switch a gear ratio between the power source and the propulsion section between a low-speed gear ratio and a high-speed gear ratio; and a control lever arranged to allow a boat operator to switch the shift position of the shift position switching mechanism and to switch the gear ratio of the gear ratio switching mechanism;

an actuator arranged to drive the shift position switching mechanism and the gear ratio switching mechanism; and a control section programmed to control the actuator to switch the shift position of the shift position switching mechanism and the gear ratio of the gear ratio switching mechanism based on a detected position of the control lever, the control method comprising:

causing the actuator to maintain the low-speed gear ratio when the current gear ratio of the gear ratio switching mechanism is the low-speed gear ratio, switch to the first shift position, and then establish the high-speed gear ratio when switching is to be performed from the neutral position to the first shift position and the high-speed gear ratio; and causing the actuator to prohibit switching to the first shift position when the current gear ratio of the gear ratio switching mechanism is the high-speed gear ratio, establish the low-speed gear ratio even though the detected position of the control lever is the first shift position and the high-speed gear ratio, switch to the first shift position, and then establish the high-speed gear ratio.

* * * * *